US012066275B2

(12) United States Patent
Coates

(10) Patent No.: US 12,066,275 B2
(45) Date of Patent: Aug. 20, 2024

(54) PAINTBALL LAND MINE AND METHODS OF MAKING AND USING SAME

(71) Applicant: Paul R. Coates, East Stroudsburg, PA (US)

(72) Inventor: Paul R. Coates, East Stroudsburg, PA (US)

( * ) Notice: Subject to any disclaimer, the term of this patent is extended or adjusted under 35 U.S.C. 154(b) by 0 days.

(21) Appl. No.: 18/096,175

(22) Filed: Jan. 12, 2023

(65) Prior Publication Data

US 2023/0204334 A1 Jun. 29, 2023

Related U.S. Application Data

(63) Continuation-in-part of application No. 17/367,377, filed on Jul. 4, 2021, now abandoned.

(51) Int. Cl.

| | |
|---|---|
| ***F42B 8/28*** | (2006.01) |
| ***F42B 12/40*** | (2006.01) |
| ***F42B 23/10*** | (2006.01) |
| ***F42C 15/42*** | (2006.01) |

(52) U.S. Cl.
CPC ..... *F42B 12/40* (2013.01); *F42B 8/28* (2013.01); *F42C 15/42* (2013.01)

(58) Field of Classification Search
None
See application file for complete search history.

(56) References Cited

U.S. PATENT DOCUMENTS

| | | | | |
|---|---|---|---|---|
| 3,492,945 | A * | 2/1970 | Filippi | F42B 8/26 102/498 |
| 4,690,061 | A * | 9/1987 | Armer, Jr. | F42B 8/28 102/407 |
| 4,944,521 | A * | 7/1990 | Greeno | F42B 12/50 473/577 |
| 5,078,117 | A * | 1/1992 | Cover | F41B 11/62 102/440 |
| 5,207,579 | A | 5/1993 | Campagnuolo | |
| 5,590,886 | A * | 1/1997 | Lush | F42B 8/26 473/577 |
| 5,877,448 | A | 3/1999 | Denton et al. | |
| 5,996,503 | A * | 12/1999 | Woodall | F42B 8/26 102/482 |
| 6,289,819 | B1 | 9/2001 | Dolderer | |
| 6,311,681 | B1 * | 11/2001 | Snyder, Jr. | F41B 11/62 124/59 |
| 6,453,819 | B1 * | 9/2002 | Coates | F42B 8/26 102/513 |

(Continued)

OTHER PUBLICATIONS

Aultec LLC, "Paintball Landmine—PBM-22c Reload," May 16, 2016, <https://www.youtube.com/channel/UCGKWlaf2cYOd9BebZMdFeEg> (Year: 2016).

*Primary Examiner* — Derrick R Morgan
(74) *Attorney, Agent, or Firm* — James R. McDaniel

(57) ABSTRACT

The present invention is generally related to paint ball firing devices. More specifically, the present invention is related to paintball land mines, which can fire multiple paintballs simultaneously and methods of making and using same. Furthermore, the present invention is capable of allowing the device to be disassembled (i.e., field serviceable) and provides a range of combustion chambers, barrel assemblies, and cartridges to be used in the device. In this manner, a wide range of projectile types and feet per second (f.p.s.) projectiles can be used in the device.

19 Claims, 16 Drawing Sheets

(56) References Cited

U.S. PATENT DOCUMENTS

| | | | | |
|---|---|---|---|---|
| 6,604,518 | B1 * | 8/2003 | Sanford | F41B 11/62 124/56 |
| 6,688,234 | B2 | 2/2004 | Huber et al. | |
| 8,245,617 | B2 * | 8/2012 | Martinez | F42B 30/00 114/382 |
| 8,613,241 | B2 * | 12/2013 | Martinez | F42B 30/00 114/382 |
| 8,978,561 | B1 * | 3/2015 | Illston | F42B 8/28 102/498 |
| 2007/0151550 | A1 * | 7/2007 | Fitting | F41B 11/00 124/73 |
| 2013/0068208 | A1 * | 3/2013 | Chu | F41B 11/89 124/71 |
| 2015/0316345 | A1 * | 11/2015 | Brahler, II | F41B 11/60 124/73 |

* cited by examiner

FIG. 13
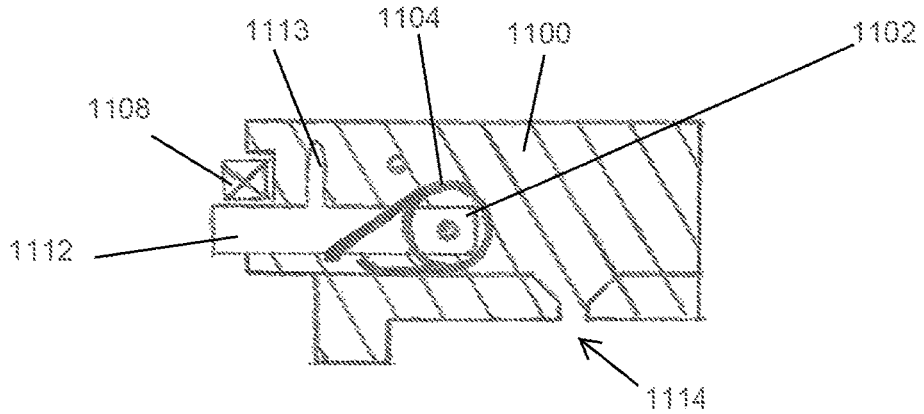
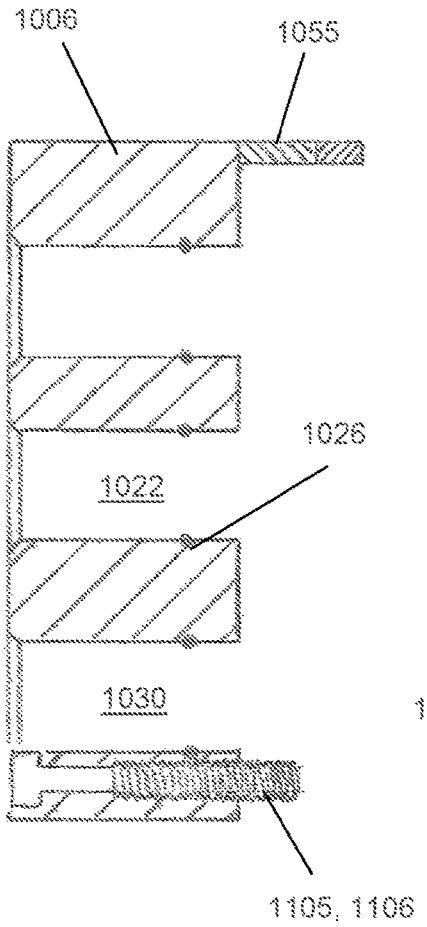
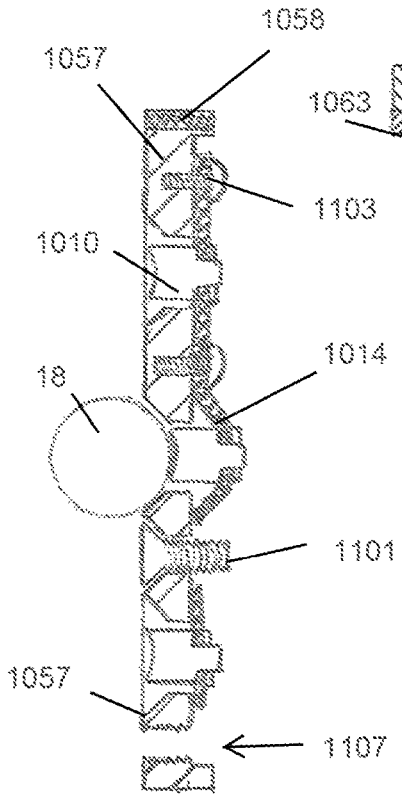
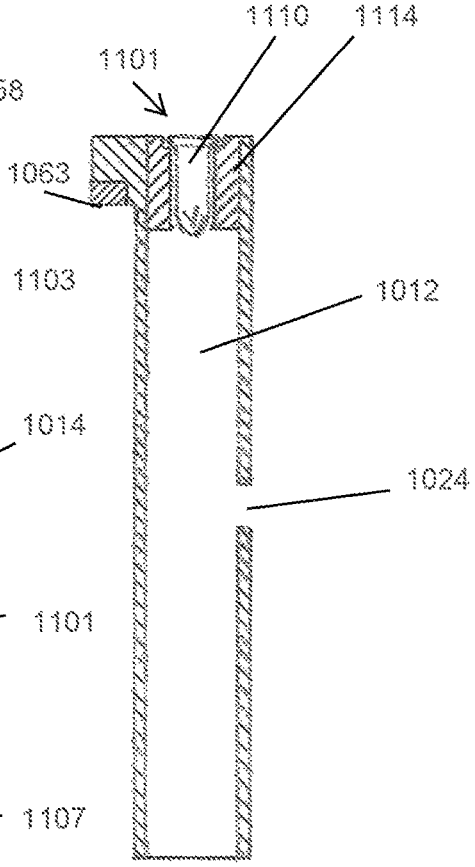
FIG. 12A FIG. 12B FIG. 12C

PAINTBALL LAND MINE AND METHODS OF MAKING AND USING SAME

CROSS-REFERENCE TO RELATED APPLICATION

This application is a continuation-in-part of U.S. patent application Ser. No. 17/367,377, filed on Jul. 4, 2021, the disclosure of which is hereby incorporated by reference in its entirety to provide continuity of disclosure to the extent such a disclosure is not inconsistent with the disclosure herein.

FIELD OF THE INVENTION

The present invention is generally related to paint ball firing devices. More specifically, the present invention is related to paintball land mines, which can fire multiple paintballs simultaneously and methods of making and using same. Furthermore, the present invention is capable of allowing the device to be disassembled (i.e., field serviceable) and provides a range of combustion chambers, barrel assemblies, and cartridges to be used in the device. In this manner, a wide range of projectile types and feet per second (f.p.s.) projectiles can be used in the device.

BACKGROUND OF THE INVENTION

Prior to the present invention, as set forth in general terms above and more specifically below, it is known, that in the game of paintball, each player has a gun that fires small balls of paint at opposing players. When a player is struck, the paintball ruptures, thereby marking the player that was struck by the paintball. Depending upon the rules of play, the marked player is either permanently put out of play, or the marked player can retreat to a replenishment area where, after a set amount of time, the marked player can rejoin the game. In the first example of play, the elimination of teams or all but a single player is the intent. However, in the second example, the conquering and holding of objectives is the purpose. Regardless of the manner of play, it is often the wish of a player or a team of players to have a device that can be set on the field of play and fire multiple paintballs with a high percentage for eliminating a player or players, or to guard an objective.

Also, it is known that the device that is set on the field of play in order to fire multiple paintballs with a high percentage for eliminating a player or players, or to guard an objective can be equipped with multiple paintballs is not field serviceable. Therefore, it would be desirable if the types of projectiles and the f.p.s. of the projectiles could be changed depending upon the desired use of the device.

Furthermore, prior to the present invention, as set forth in general terms above and more specifically below, it is known, to employ various types of paintball firing devices. See for example, U.S. Pat. No. 5,207,579 by Campagnuolo, U.S. Pat. No. 5,590,886 by Lush, U.S. Pat. No. 5,877,448 by Denton et al., U.S. Pat. No. 5,996,503 by Woodall et al., U.S. Pat. No. 6,289,819 by Dolderer, U.S. Pat. No. 6,453,819 by Coates, U.S. Pat. No. 6,688,234 by Huber et al., and U.S. Pat. No. 8,978,561 by Illston. While these various paintball firing devices may have been generally satisfactory, there is nevertheless a need for a new and improved paintball land mine, which can fire multiple paintballs simultaneously.

It is a goal of the present invention to provide a paintball land mine which can fire multiple paintballs simultaneously.

It is another goal of the present invention to provide a paintball land mine that utilizes a firearm blank or nail gun cartridge for its propellant.

It is still a further goal of the present invention to provide a paintball land mine which includes reed valves associated with the ejection of the paintballs so that after the initial blast of the propellant to eject each paintball, the reed valve associated with the ejected paintball is closed, thereby preventing the rapid escape of unused propellant.

It is an even further goal of the present invention to provide a paintball land mine that is either detonated by a trip wire or detonated electronically through the use a remote-control device.

It is a still further goal of the present invention to provide a paintball land mine that is capable of allowing the device to be disassembled (i.e., field serviceable) and provides a range of combustion chambers, barrel assemblies, and cartridges to be used in the device. In this manner, a wide range of projectile types and feet per second (f.p.s.) projectiles can be used in the device.

The preferred paintball land mine, according to various embodiments of the present invention, offers the following advantages: ease of use; lightness in weight; durability; reusability; the ability to fire multiple paintballs simultaneously; the ability to utilize a firearm blank or nail gun cartridge for its propellant; the use of reed valves associated with the ejection of the paintballs; the ability to substantially prevent the rapid escape of unused propellant; the ability to detonate the land mine using a trip wire; the ability to use a wide range of projectile types; the ability to use a wide range of f.p.s. projectile types; the ability to be able to disassemble/service the device; and the ability to detonate the land mine using a remote-control device. In fact, in many of the preferred embodiments, these advantages are optimized to an extent that is considerably higher than heretofore achieved in prior, known paintball firing devices.

It is a purpose of this invention to fulfill these and other needs in the paintball firing devices art in a manner more apparent to the skilled artisan once given the following disclosure.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which:

FIGS. 12A-12C are schematic, side views of barrel assembly, the reed valve manifold, and the combustion chamber, constructed according the present invention;

FIG. 13 is a schematic view of the another embodiment of the paintball land mine, taken along lines 13-13 of FIG. 8, illustrating the trigger assembly, constructed according the present invention;

DETAILED DESCRIPTION OF THE PREFERRED EMBODIMENTS OF THE INVENTION

It is a common misconception that gun powder is an explosive. In fact, it is a propellant. Therefore, certain conditions must be met for it to burn, namely heat and pressure. In a conventional firearm, this is achieved by the projectile being crimped into the cartridge during manufacturing, and the tight fit between the projectile and the barrel.

Once the primer on the firearm cartridge is struck, the short, hot burst of gases that are produced are trapped along with the propellant, thereby causing some of the nitrocellous (commonly known as gun powder) to ignite. Furthermore, still trapped inside the cartridge, the small amount of burning propellant ignites more propellant and a rapid expansion of pressure and heat begins until the limit of adhesion between the projectile and the cartridge are overcome, and the projectile is forced out of the cartridge and into the barrel. Frictional forces between the projectile and barrel require the highest pressures resulting in a complete propellant burn, thousands of pounds of pressure, and heat. It is to be understood that in the case of a blank cartridge, the projectile is replaced with a metallic, paper, or plastic case that encloses the gun powder and the primer.

In order to address the shortcomings of the prior, known paintball firing devices, it would be desirable to utilize a novel, paintball land mine, which can fire multiple paint balls simultaneously. It would be further desirable to provide a paintball land mine that utilizes a firearm blank or nail gun cartridge for its propellant. It would be even further desired to provide a paintball land mine which includes reed valves associated with the ejection of the paintballs so that after the initial blast of the propellant to eject each paintball, the reed valve associated with the ejected paintball is closed, thereby preventing the rapid escape of unused propellant. Also, it would be still further desired to provide a paintball land mine that is either detonated by a trip wire or detonated electronically through the use a remote-control device. Finally, it would be desirable to provide a paintball land mine that is capable of allowing the device to be disassembled (i.e., field serviceable) and provides a range of combustion chambers, barrel assemblies, and cartridges to be used in the device. In this manner, a wide range of projectile types and feet per second (f.p.s.) projectiles can be used in the device.

Figure 1:
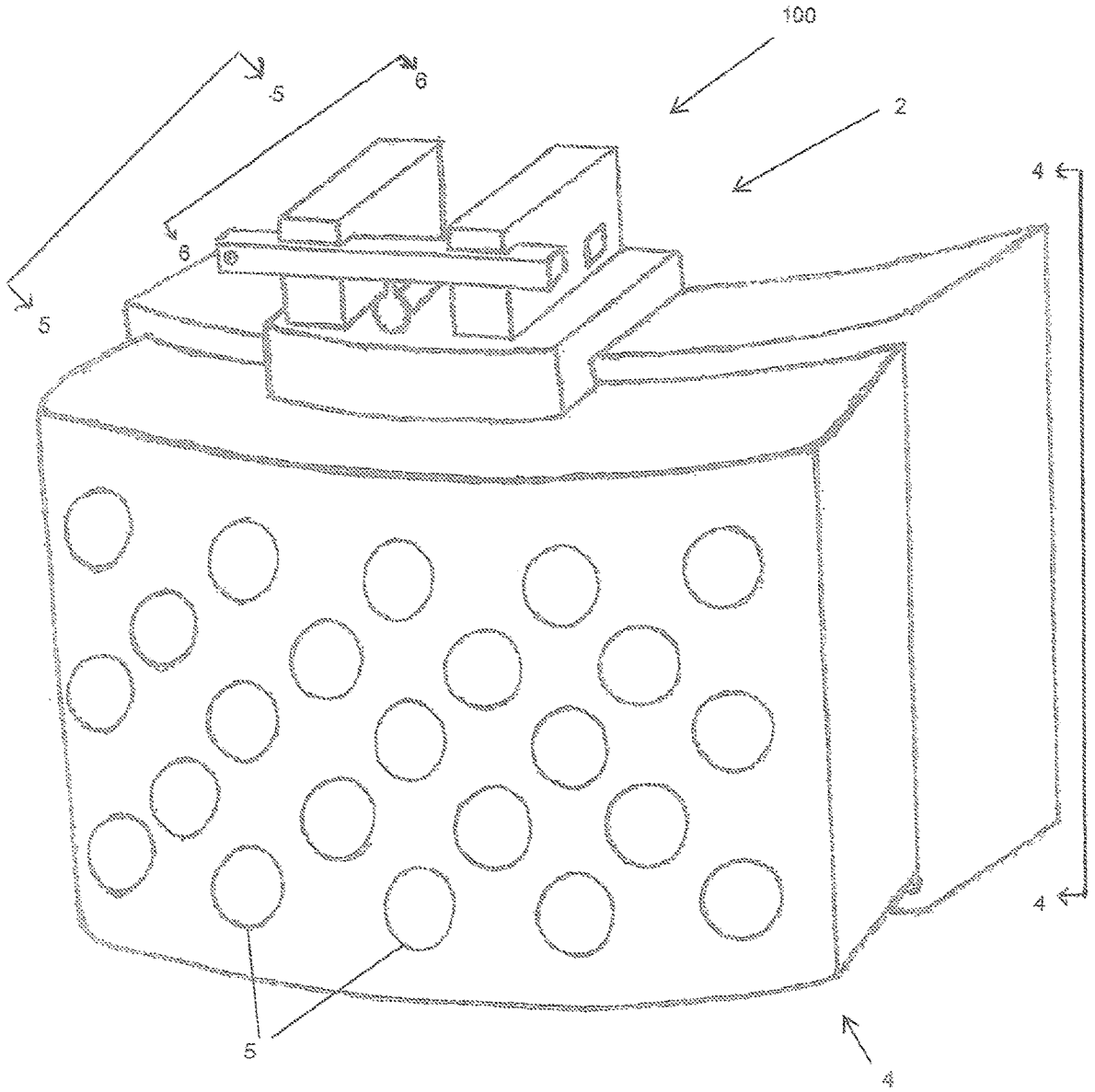
FIG. 1 is a schematic, isometric illustration of a paintball land mine, constructed according the present invention.
Figure 2:
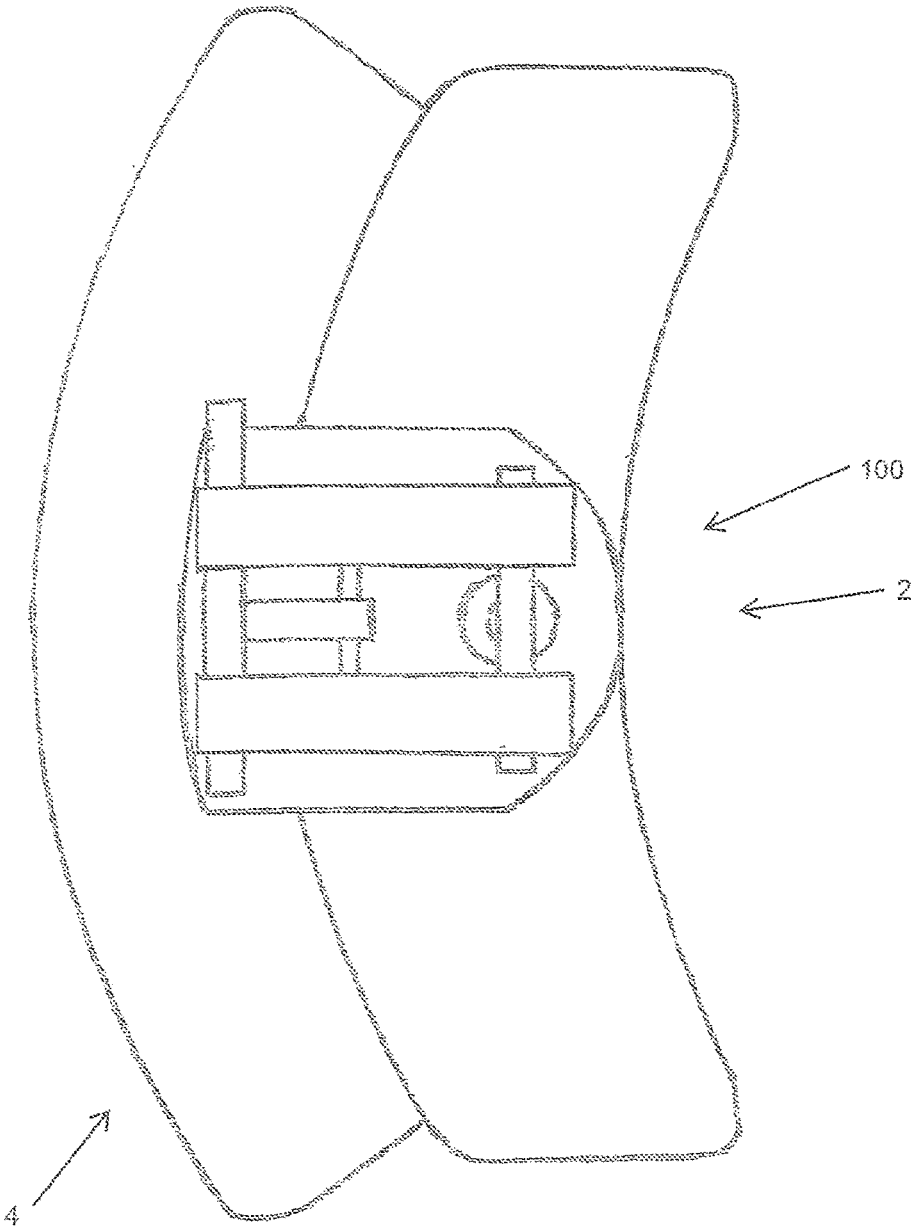
FIG. 2 is a schematic, top view of the paintball land mine, constructed according the present invention.

Reference is made now to FIGS. 1 and 2, where there is illustrated a paintball land mine 2, wherein the paintball land mine 2 includes, in part, paintball land mine assembly 4 and manual trigger assembly 100. As shown in FIGS. 1 and 2, paintball land mine assembly 4 includes, in part, openings 5 located on the front of paintball land mine assembly 4.

Figure 3:
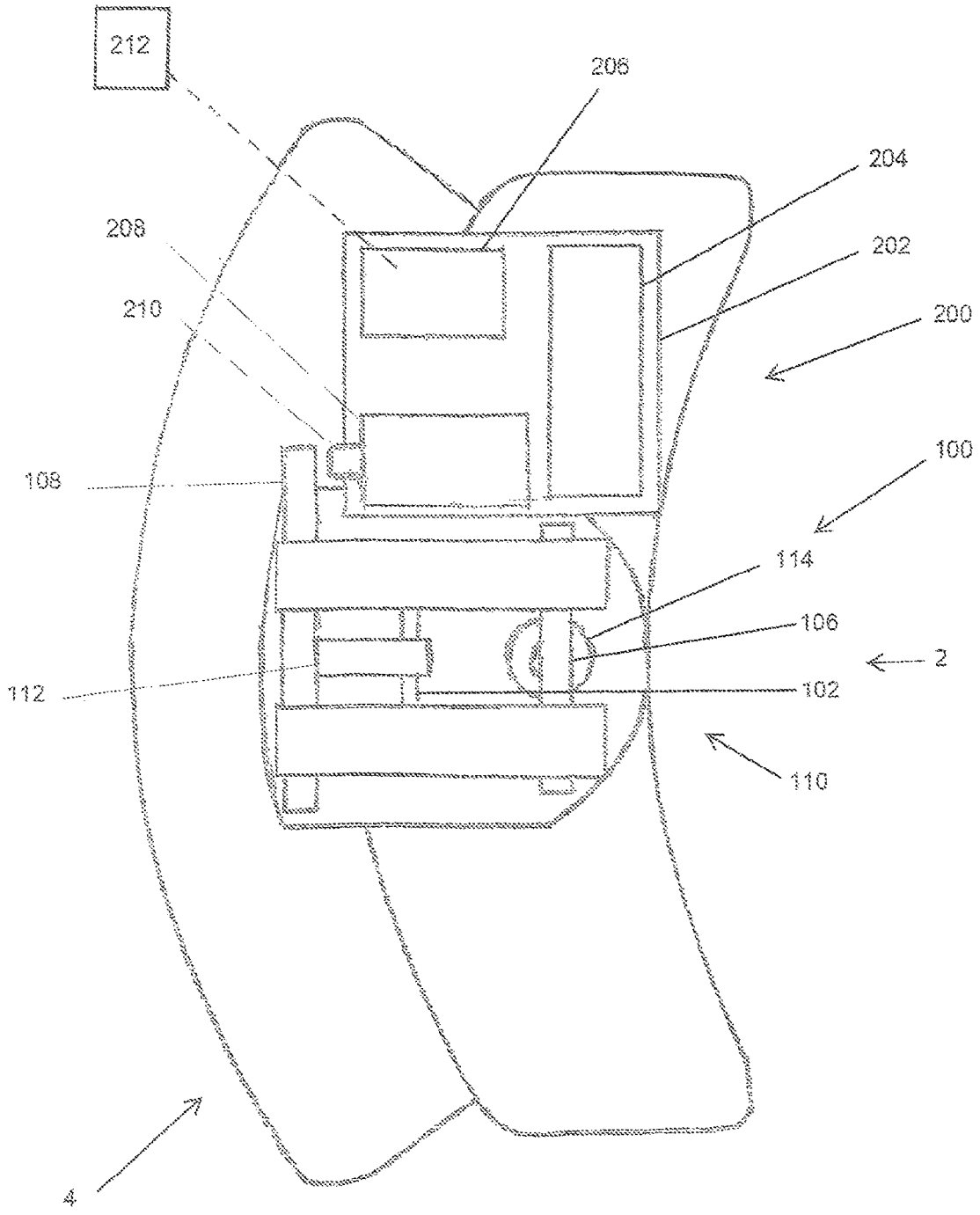
FIG. 3 is a schematic, top view of the paintball land mine, showing the electronic trigger assembly attached, constructed according the present invention.

With respect to FIG. 3, FIG. 3 illustrates electronic trigger assembly 200 being attached to the top of paintball land mine 2 such that electronic trigger assembly 200 is located adjacent to manual trigger assembly 100. Preferably, electronic trigger assembly 200 is constructed of electronic trigger 202, conventional battery 204, conventional receiver 206, and conventional solenoid 208 having a movable extension 210 such that movable extension 210 is capable of interacting with trip pin 108 on manual trigger assembly 100 in order to activate paintball land mine 2, as will be discussed in greater detail later. Battery 202 should be constructed such that battery 202 is capable of providing the required power to electronic trigger assembly 200. Also, receiver 206 should be constructed such that receiver 206 is capable of receiving electronic signals from a conventional remote-control device 212. In this manner, remote-control device 212 can be conventionally used to send an electronic signal to receiver 206 in order to cause solenoid 208 and extension 210 to interact with trip pin 108 in order to activate paintball land mine 2. Finally, solenoid 208 should be capable of receiving a signal from receiver 206 that will cause solenoid 208 to move extension 210 such that movable extension 210 is capable of interacting with trip pin 108 in order to activate paintball land mine 2.

A unique aspect of the present invention is the use of electronic trigger assembly 200. Electronic trigger assembly 200 allows for the remote-control activation of paintball land mine 2. In particular, remote-control device 212 can be conventionally used to send an electronic signal to receiver 206 in order to cause electronic trigger assembly 200 to interact with trip pin 108 in order to activate paintball land mine 2. In this manner, the paintball land mine 2 can be set on the field of play and fire multiple paintballs 18 (FIG. 4) with a high percentage for eliminating a player or players, or to guard an objective without the user having to be in close proximity to the paintball land mine 2.

It is to be understood that while the use of an electronic trigger assembly 200 has been discussed, a conventional trip wire (not shown) can also be attached to the trip pin 108. In this manner, the paintball land mine 2 can still be set on the field of play and fire multiple paintballs 18 with a high percentage for eliminating a player or players, or to guard an objective without the user having to be in close proximity to the paintball land mine 2.

Also shown in FIG. 3, is a portion of manual trigger assembly 100. In particular, manual trigger assembly 100 includes, in part, hammer hinge bolt 102, breach block 106, trip pin 108, cartridge 110, hammer 112, and breach 114 which will be discussed in greater detail later.

Figure 4:
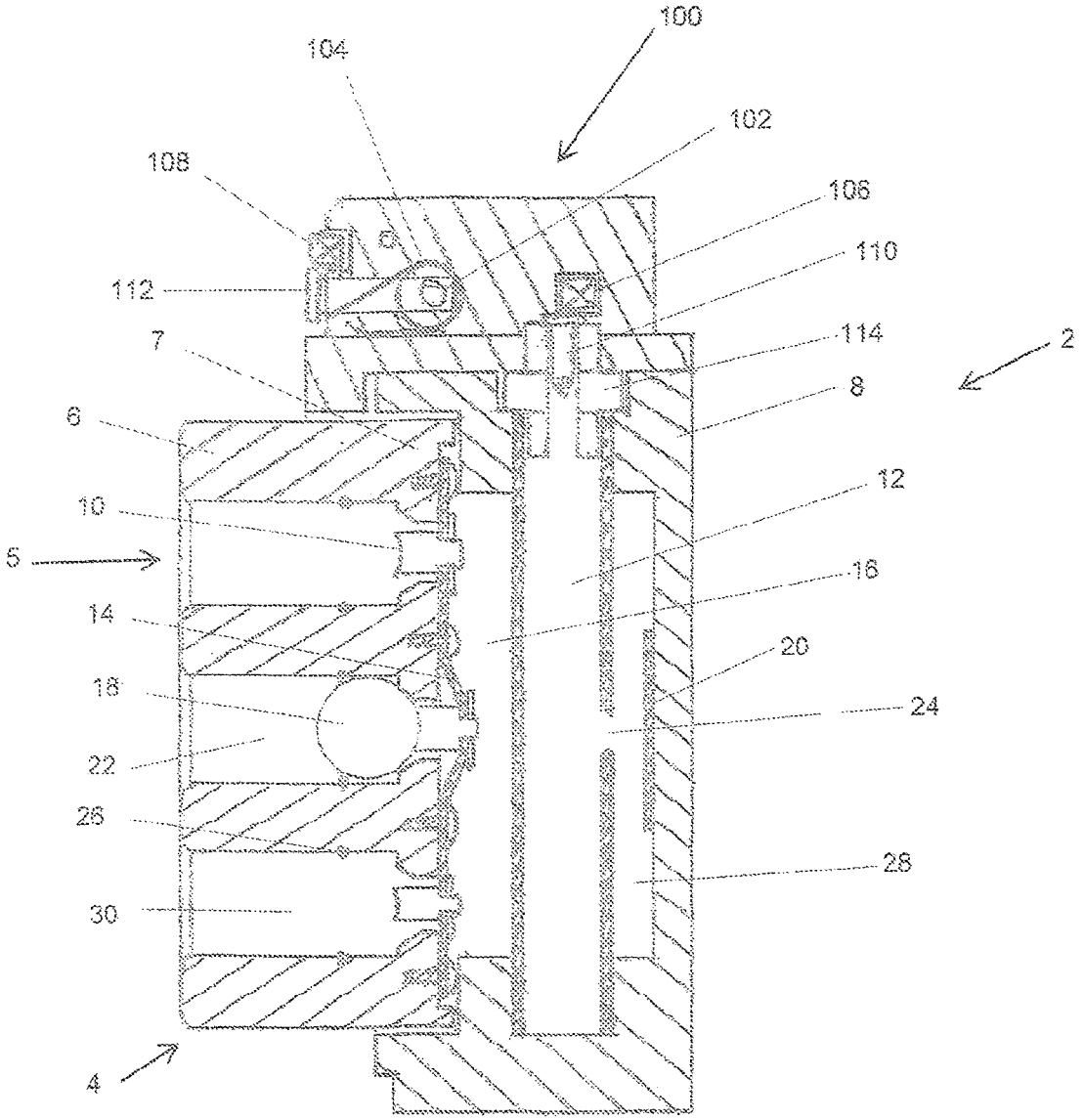
FIG. 4 is a schematic, side view of the paintball land mine, taken along lines 4-4 of FIG. 1, constructed according the present invention.
Figure 5:
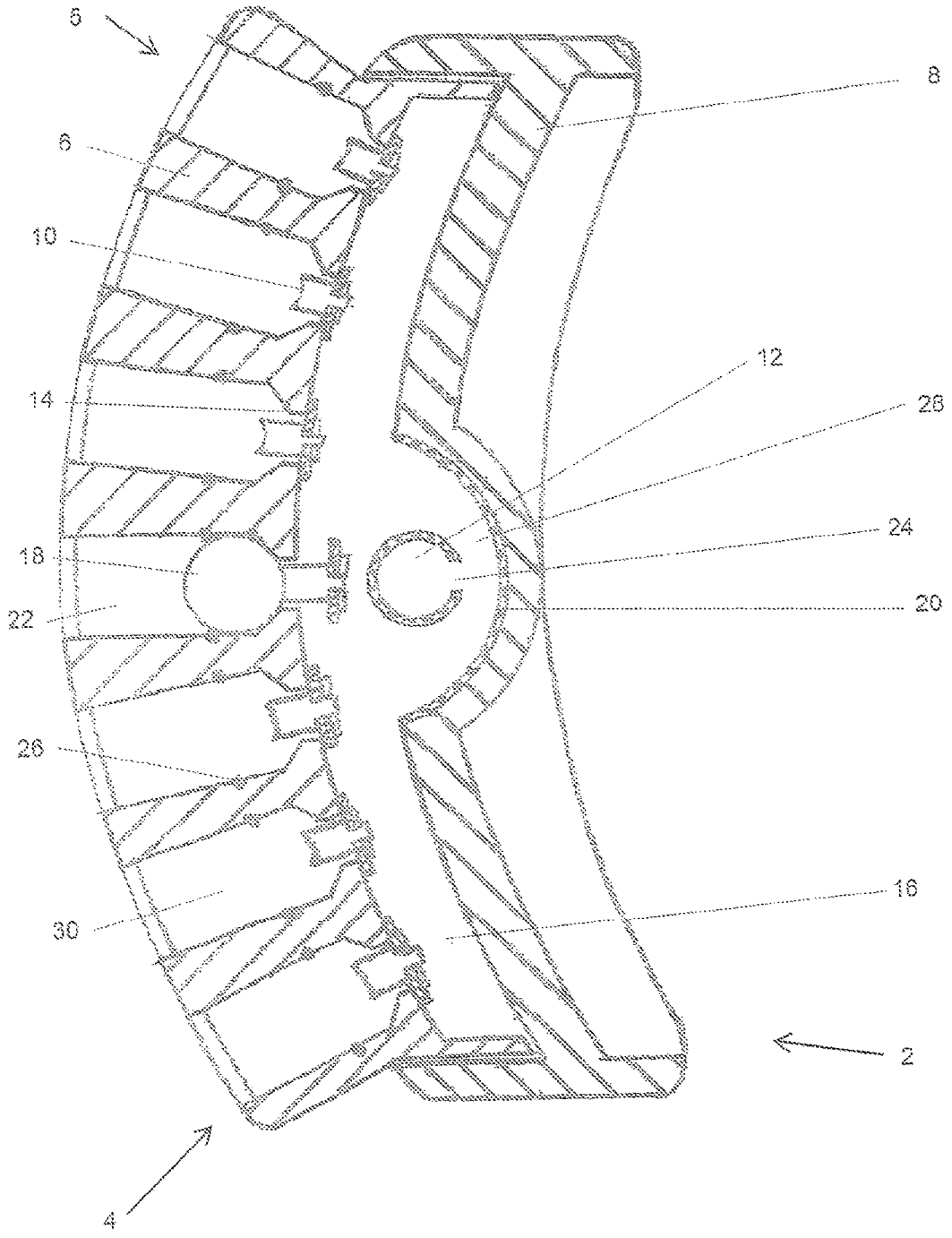
FIG. 5 is a schematic, top view of the paintball land mine, taken along lines 5-5 of FIG. 1, constructed according the present invention.

With respect to FIGS. 4 and 5, there is illustrated in greater detail paintball land mine assembly 4 and manual trigger assembly 100. As shown in FIGS. 4 and 5, paintball land mine assembly 4 includes, in part, opening 5, barrel assembly 6, annular wall 7, main body 8, reed valve standoff 10, combustion chamber 12, reed valve 14, main body/barrel assembly expansion chamber 16, paintball 18, heat shield 20, barrel pre-detonation 22, combustion chamber exhaust port 24, barrel restrictor 26, expansion/diverter section 28, and barrel post detonation 30. Preferably, barrel assembly 6, main body 8, reed valve standoff 10, reed valve 14, and heat shield 20 are constructed of any suitable high strength, durable, heat resistant, high pressure resistant, UV resistant material.

It is to be understood that reed valve standoff 10 and reed valve 14 operate in substantially the same manner as discussed in U.S. Pat. No. 6,453,819 to Coates and titled "Paint Ball Grenade". In particular, a plurality of barrel restrictors 26 are radially located to an outer surface of paintball land mine assembly 4 in alignment with openings 5. A flexible reed valve 14 of rubber, plastic, metal or other suitable material has one end mounted to the inner surface of annular wall 7 in a covering relation to each opening 5. Reed valve 14 can be constructed to be normally pre-biased to a position to close the respective opening 5, although this is not required by the present invention. As shown in FIG. 4, each reed valve 14 can be moved in a radially inward direction by inserting paintball 18 into barrel restrictor 26 so as to provide fluid communication between the respective opening 5 and main body/barrel assembly expansion chamber 16. Although reed valves 14 are shown attached at only one end, reed valves 14 can be attached at opposite ends on opposite sides of openings 5 so that only the middle portion of each reed valve 14 moves in a radially inward direction. A reed valve standoff 10 is secured to the radially directed outer surface of each reed valve 14 and extends through the respective opening 5 and partially within the barrel restrictor 26.

Another unique aspect of the present invention is the use of reed valve standoff 10 and reed valve 14. In particular, initially, the propellant exits very fast through openings 5 to push out and fire paint balls 18 from barrel restrictor 26. However, after the first paint ball 18 is fired, the resistance provided by that paint ball 18 against reed valve standoff 10 and reed valve 14 no longer exists so that the propellant would quickly exit out of the barrel restrictor 26 from which the first paint ball 18 was fired, since this is the path of least resistance. However, after each paint ball 18 is fired, the respective reed valve standoffs 10 are no longer restrained, so that the propellant then forces the respective reed valves 14 to the closed position of FIG. 4, thus sealing the respective openings 5. In this manner, the remaining propellant is still used to fire the other paint balls 18.

With respect to manual trigger assembly 100, as shown in FIG. 4, manual trigger assembly 100 includes in part, hammer hinge bolt 102, torsion spring 104, breach block 106, trip pin 108, nail gun/blank firearm cartridge 110, hammer 112, and breach 114. Preferably, hammer hinge bolt 102, torsion spring 104, breach block 106, trip pin 108, hammer 112, and breach 114 are constructed of any suitable high strength, durable, heat resistant, high pressure resistant, UV resistant material. It is to be understood that nail gun/blank firearm cartridge 110 is any conventional nail gun or blank firearm cartridge or a round is a type of pre-assembled, blank firearm ammunition packaging a propellant substance (usually either smokeless powder or gun powder) and an ignition device (primer) within a metallic, paper, or plastic case. It is to be further understood that nail gun/blank firearm cartridge 110 should be made to fit within the breach 114. It is to be understood that hammer 112 is conventionally attached to hammer hinge bolt 102 by conventional fastening techniques such as welding, soldering, adhesives or the like.

Figure 6:
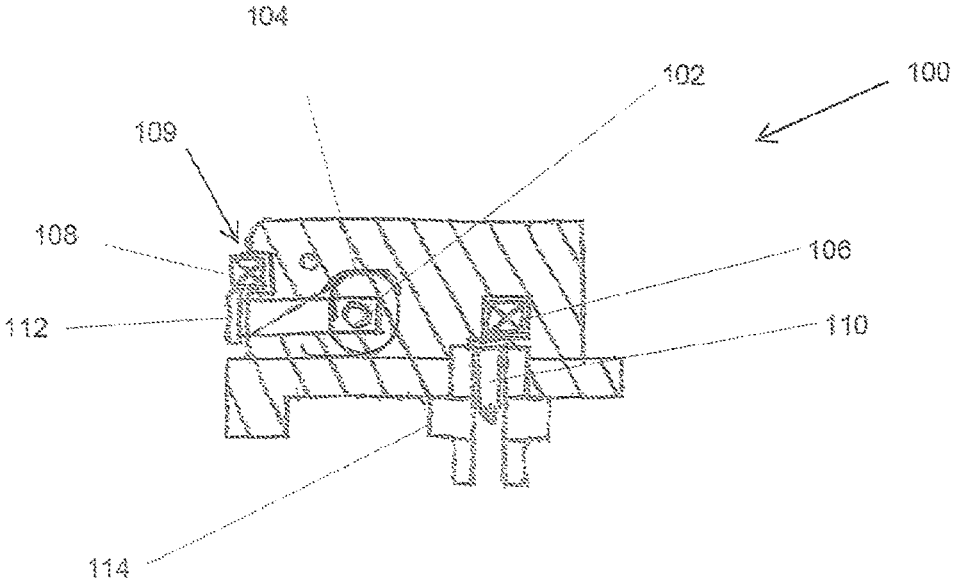
FIG. 6 is a schematic, top view of the paintball land mine, taken along lines 6-6 of FIG. 1 with the manual trigger assembly in a pre-detonation mode, constructed according the present invention.

With respect to FIG. 6, there is illustrated manual trigger assembly 100, prior to activation (pre-detonation) of manual trigger assembly 100. As discussed above, manual trigger assembly includes, in part, hammer hinge bolt 102, torsion spring 104, breach block 106, trip pin 108, cartridge 110, hammer 112, and breach 114. As shown in FIG. 6, hammer 112 is rotated into a locked position adjacent to the trip pin 108 such that trip pin 108 retains hammer 112 in place by locating trip pin 108 within groove 109. It is to be understood that the rotation of hammer 112 creates torsion on torsion spring 104. In this manner, once the trip pin 108 is removed away from groove 109 and hammer 112, the force on torsion spring 104 will cause hammer 112 to rotate quickly towards cartridge 110.

Figure 7:
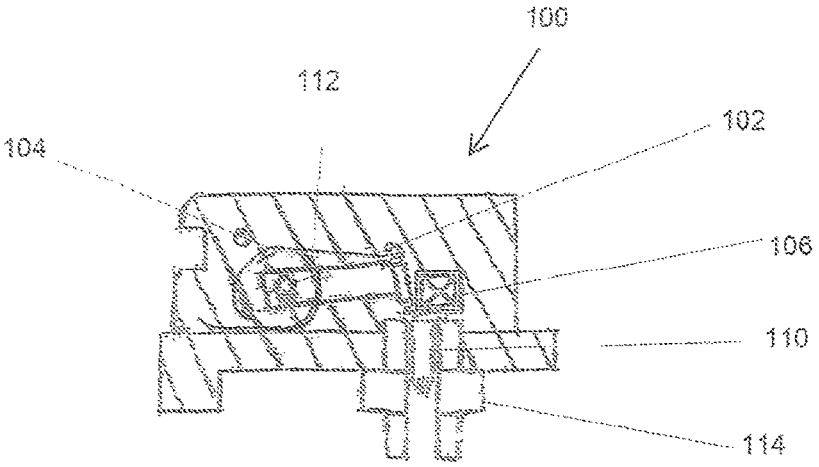
FIG. 7 is a schematic, top view of the paintball land mine with the manual trigger assembly in a post-detonation mode, constructed according the present invention.

With respect to FIG. 7, there is illustrated manual trigger assembly 100, after activation (post-detonation) of manual trigger assembly 100. As shown in FIG. 7, trip pin 108 has been removed from groove 109 so that trip pin 108 no longer retains hammer 112 in place. As discussed above, since the rotation of hammer 112 creates torsion on torsion spring 104, once the trip pin 108 has been removed from groove 109, the torsional force from torsion spring 108 will cause hammer 112 to rotate quickly on hammer hinge bolt 102 towards cartridge 110 so that hammer 112 contacts cartridge 110 to cause the conventional firing of cartridge 110. Once the cartridge 110 has been fired (or activated), the propellant created from the firing of the gun powder in cartridge 110 will enter into combustion chamber 12, as will be described in greater detail later.

Method of Using the Paintball Land Mine

With respect to the method of using paintball land mine 2 and with reference to FIGS. 1-7, as discussed above, it is a common misconception that gun powder is an explosive. In fact, it is a propellant. Therefore, certain conditions must be met for it to burn, namely heat and pressure. In a conventional fire arm, this is achieved by the projectile being crimped into the cartridge during manufacturing, and the tight fit between the projectile and the barrel. It is to be understood that the projectile in the cartridge has been removed. Instead, as discussed above, the cartridge 110 is any conventional nail gun or blank firearm cartridge 110 or a round that is a type of pre-assembled, blank firearm ammunition packaging a propellant substance (usually either smokeless powder or gun powder) and an ignition device (primer) within a metallic, paper, or plastic case.

During the operation of paintball land mine 2, assume that remote-control device 212 can be conventionally used to send an electronic signal to receiver 206 in order to cause electronic trigger assembly 200 to interact with trip pin 108 in order to activate paintballs landmine 2. It is to be understood that a conventional trip wire (not shown) or other similar detonation device can also be used to activate or otherwise detonate paintball land mine 2.

As discussed earlier, the user places the paintball land mine 2 on the field of play so that the paintball land mine 2 will be able to fire multiple paintballs 18 with a high percentage for eliminating a player or players, or to guard an objective.

Once the paintball land mine 2 has been placed at it desired location, the user then conventionally connects the electronic trigger assembly 200 to the manual trigger assembly 100. In particular, the receiver 206 should be constructed such that receiver 206 is capable of receiving electronic signals from a conventional remote-control device 212. In this manner, remote-control device 212 can be conventionally used to send an electronic signal to receiver 206 in order to cause electronic trigger assembly 200 to interact with trip pin 108 in order to activate landmine assembly 2. More particularly, solenoid 208 should be capable of receiving a signal from receiver 206 that will cause solenoid 208 to move extension 210 such that movable extension 210 is capable of interacting with trip pin 108 in order to activate paintball land mine 2 by causing trip pin 108 to become dislodged from groove 109 in order to allow hammer 112 to rotate and contact cartridge 110.

After hammer 112 becomes dislodged from being retained by trip pin 108, as discussed above, the force on torsion spring 104 will cause hammer 112 to rotate quickly towards cartridge 110.

The force of the torsion spring 104 will then cause the hammer 112 to contact cartridge 110. As discussed earlier, the interaction of the hammer 112 on cartridge 110 will cause the ignition of the gun powder in cartridge 110. Once the cartridge 110 has been fired (or activated), the propellant created from the firing of the gun powder in cartridge 110 will enter in breach 114.

Once the primer is struck, the short, hot pulse of gases that are produced are trapped along with the propellant, thereby causing some of the gun powder to ignite. Furthermore, still trapped inside the cartridge, the small amount of burning propellant ignites more propellant and a rapid expansion of pressure and heat begins until the limit of adhesion of the cartridge case are overcome, and the propellant is forced out of the cartridge 110 and into the combustion chamber 12.

The propellant consisting of a short pulse of hot, high-speed gases then proceeds down along combustion chamber 12. It is to be understood that the rearward facing combustion chamber exhaust port 24 directs the hot, high-speed gases against the heat shield 20, thereby causing the hot, high speed gases to spread out, slow down, and cool down. Furthermore, while the combustion chamber 12 serves as a divider to split the hot, high-speed gases, further progression of the hot, high speed gases causes the hot, high speed gases to enter into the main body/barrel assembly expansion chamber 16. Once in the in the main body/barrel assembly expansion chamber 16, the hot, high-speed gases then reconverge around the combustion chamber 12. This collision along with the further expansion of the hot, high-speed gases creates a loss of heat which results in an environment that is compatible with the reed valves 14. The hot, high-speed gases have now been altered (or massaged) so that the massaged hot, high speed gases now head down the remainder of the main body/barrel assembly expansion chamber 16.

Regarding reed valve standoffs 10 and reed valves 14, as discussed earlier, a plurality of barrel restrictors 26 are radially located to an outer surface of paintball land mine assembly 4 in alignment with openings 5. A flexible reed valve 14 of rubber, plastic, metal or other suitable material has one end mounted to the inner surface of annular wall 7 in covering relation to each opening 5. Reed valve 14 can be constructed to be normally pre-biased to a position to close the respective opening 5, although this is not required by the present invention. As shown in FIG. 4, each reed valve 14 can be moved in a radially inward direction by inserting paintball 18 into barrel restrictor 26 so as to provide fluid communication between the respective opening 5 and main body/barrel assembly expansion chamber 16. Although reed valves 14 are shown attached at only one end, reed valves 14 can be attached at opposite ends on opposite sides of openings 5 so that only the middle portion of each reed valve 14 moves in a radially inward direction. A reed valve standoff 10 is secured to the radially directed outer surface of each reed valve 14 and extends through the respective opening 5 and partially within the barrel restrictor 26.

Another unique aspect of the present invention is the use of reed valve standoff 10 and reed valve 14. In particular, initially, the propellant exits very fast through openings 5 to push out and fire paint balls 18 from barrel restrictor 26. However, after the first paint ball 18 is fired, the resistance provided by that paint ball 18 against reed valve standoff 10 and reed valve 14 no longer exists so that the propellant would quickly exit out of the barrel restrictor 26 from which the first paint ball 18 was fired, since this is the path of least resistance. However, after each paint ball 18 is fired, the respective reed valve standoffs 10 are no longer restrained, so that the propellant then forces the respective reed valves 14 to the closed position of FIG. 4, thus sealing the respective openings 5. In this manner, the remaining propellant is still used to fire the other paint balls 18.

A still another unique aspect of the present invention is the ability to be able to aim or otherwise direct the exhaust from the firing of the cartridge 110. It is to be understood that if the hot, high-speed gases were allowed to escape in all directions, the result would be the destruction of the delicate reed valves 14. In particular, in the present invention, a rearward facing combustion chamber exhaust port 24 directs the hot, high-speed gases against the heat shield 20, thereby causing the hot, high speed gases to spread out, slow down, and cool down. While the combustion chamber 12 serves as a divider to split the hot, high-speed gases, further progression of the hot, high speed gases causes the hot, high speed gases to enter into the main body/barrel assembly expansion chamber 16. Once in the in the main body/barrel assembly expansion chamber 16, the hot, high-speed gases then reconverge around the combustion chamber 12. This collision along with the further expansion of the hot, high-speed gases creates a loss of heat which results in an environment that is compatible with the reed valves 14. The hot, high-speed gases have now been altered (or massaged) so that the massaged hot, high speed gases now head down the remainder of the main body/barrel assembly expansion chamber 16.

It is to be understood that once the primer is struck, the short, hot burst of gases that are produced are trapped along with the propellant, thereby causing some of the gun powder to ignite. Furthermore, still trapped inside the cartridge, the small amount of burning propellant ignites more propellant and a rapid expansion of pressure and heat begins until the limit of adhesion of the cartridge case is overcome, and the short burst of hot, high-speed gases is forced out of the cartridge and into the breach 114. Forces within the combustion chamber 12 require the highest pressures thereby, resulting in a complete propellant burn, hundreds of pounds of pressure, and heat.

Given the above, in terms of the present invention, if one were to remove the combustion chamber 12 (FIGS. 4 and 5) and strike the cartridge 110, detonation of the primer (not shown) within the cartridge would have enough force to open the cartridge 110 and eject propellant into the body/barrel assembly expansion chamber 16. However, the small amount of burning propellant ignited by the primer lacks a confined space to ignite any further propellant, thereby resulting in a very low, incomplete burn of the propellant.

Another unique aspect of the present invention is that by using a combustion chamber 12, one will see that there is a now confined space that creates a high heat, high pressure environment for the unignited propellant which results in a more complete burn of the propellant.

A still another unique aspect of the present invention is the ability to be able to aim or otherwise direct the exhaust from the firing of the cartridge 110. It is to be understood that if the hot, high-speed gases were allowed to escape in all directions, the result would be the destruction of the delicate reed valves 14. In particular, in the present invention, a rearward facing combustion chamber exhaust port 24 directs the hot, high-speed gases against the heat shield 20, thereby causing the hot, high speed gases to spread out, slow down, and cool down. While the combustion chamber 12 serves as a divider to split the hot, high-speed gases, further progression of the hot, high speed gases causes the hot, high speed gases to enter into the main body/barrel assembly expansion chamber 16. Once in the in the main body/barrel assembly expansion chamber 16, the hot, high-speed gases then reconverge around the combustion chamber 12. This collision along with the further expansion of the hot, high-speed gases creates a loss of heat which results in an environment that is compatible with the reed valves 14. The hot, high-speed gases have now been altered (or massaged) so that the massaged hot, high speed gases now head down the remainder of the main body/barrel assembly expansion chamber 16.

Another Embodiment of the Land Mine

Figure 8:
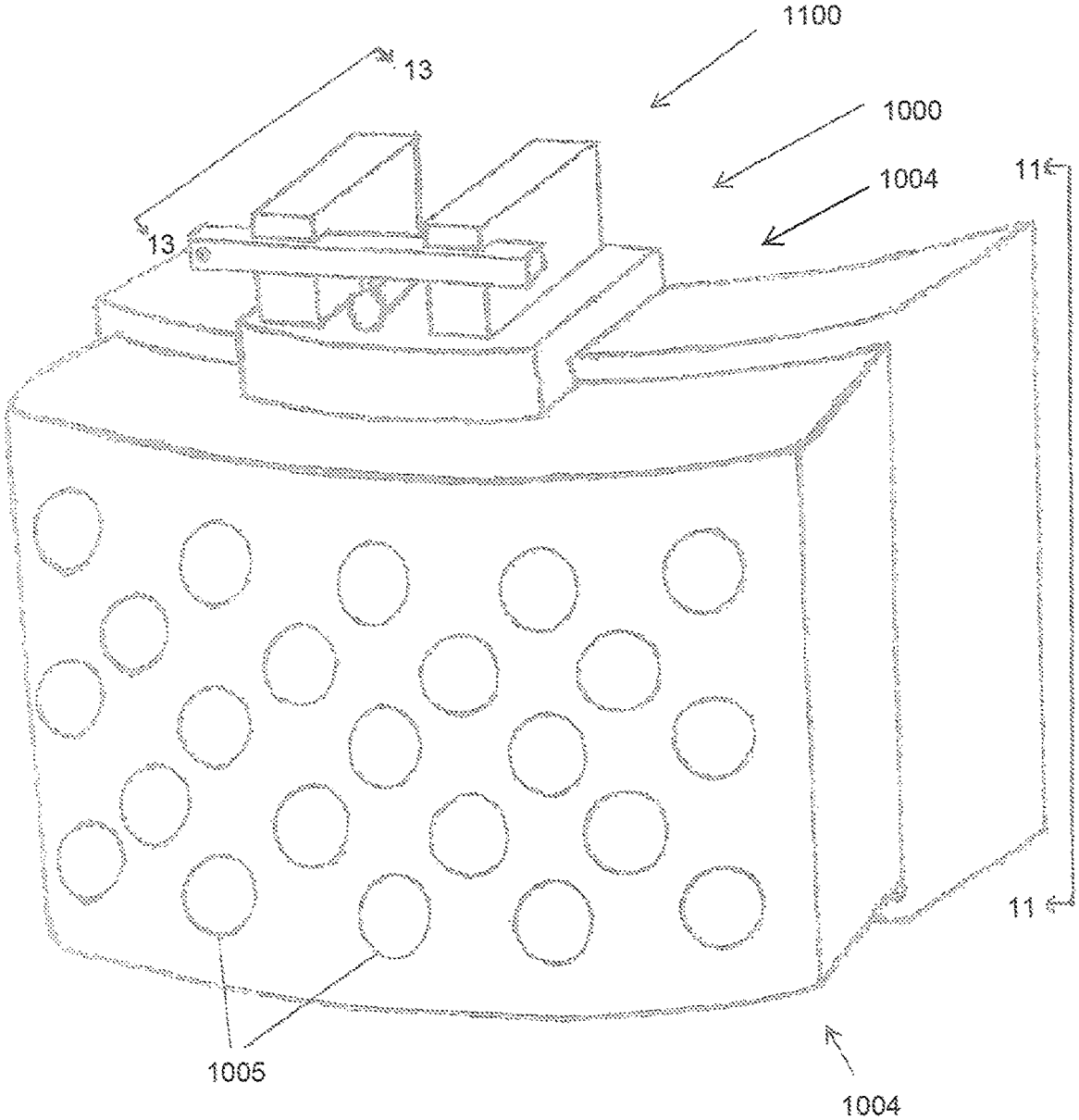
FIG. 8 is a schematic, isometric illustration of another embodiment of the paintball land mine, constructed according the present invention.
Figure 9:
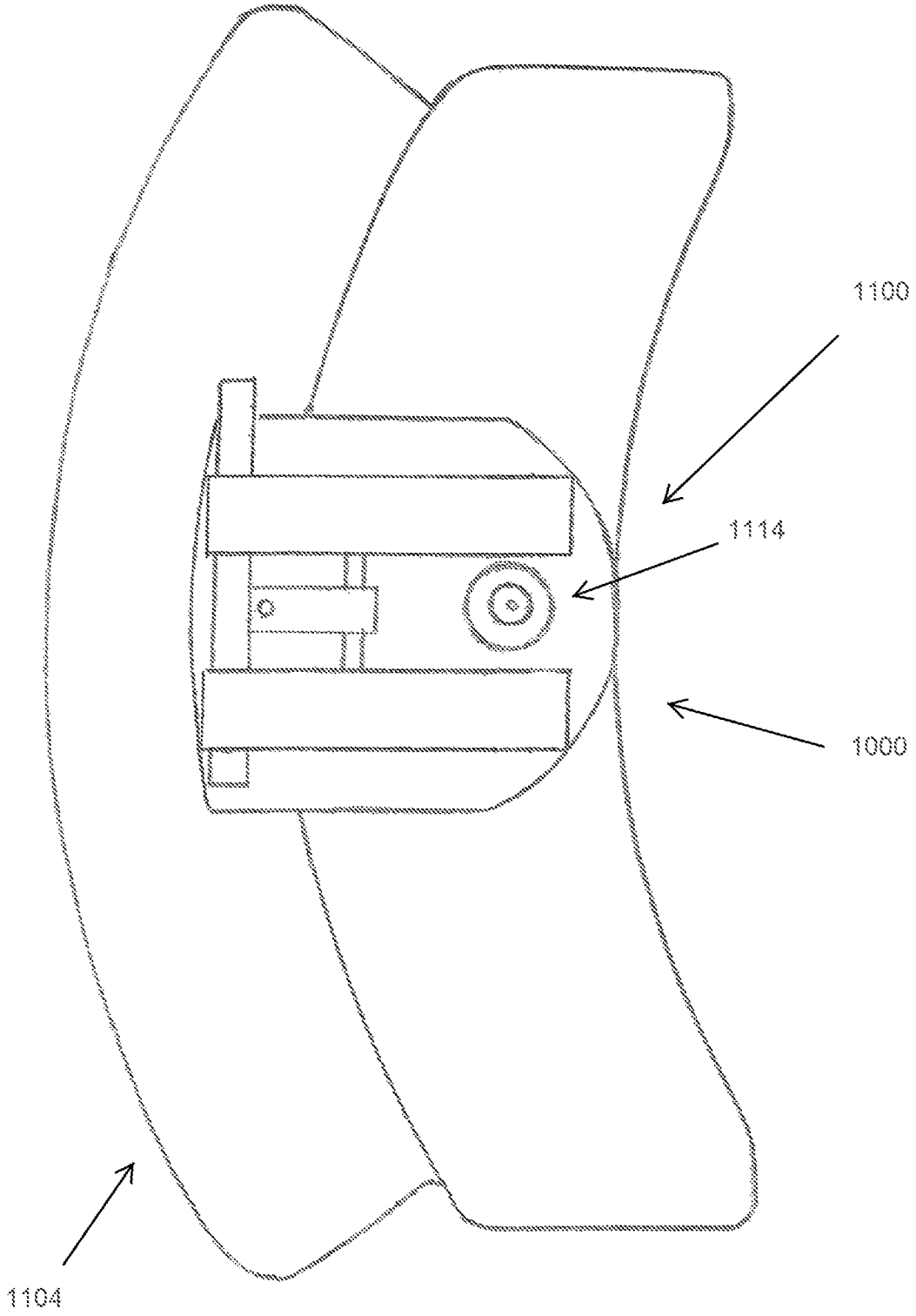
FIG. 9 is a schematic, top view of the another embodiment of the paintball land mine, constructed according the present invention.

Reference is made now to FIGS. 8 and 9, where there is illustrated another embodiment of a paintball land mine 1000, wherein the paintball land mine 1000 includes, in part, paintball land mine assembly 1004 and manual trigger assembly 1100. As shown in FIGS. 8 and 9, paintball land mine assembly 1004 includes, in part, openings 1005 located on the front of paintball land mine assembly 1004.

Figure 10:
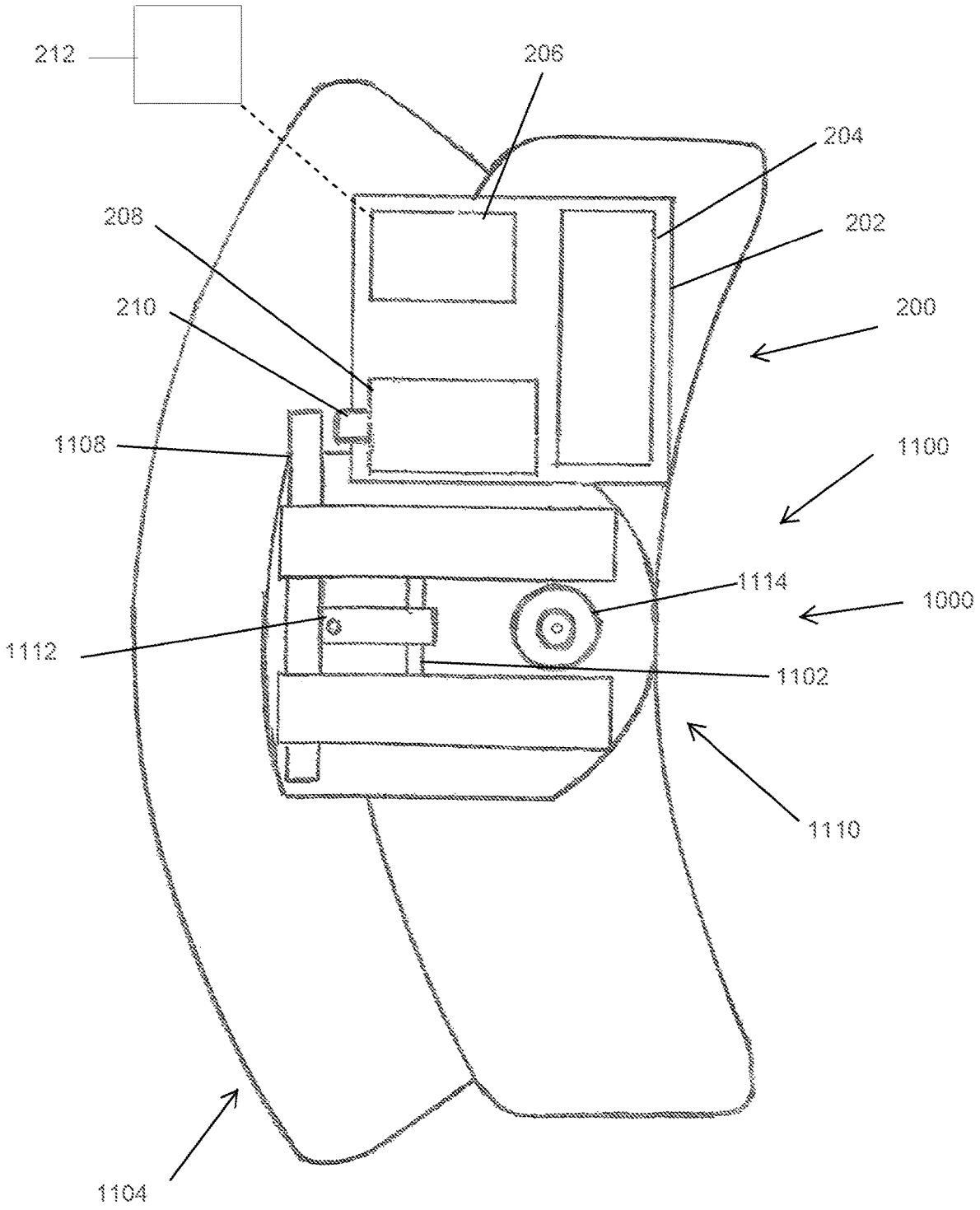
FIG. 10 is a schematic, top view of the another embodiment of the paintball land mine, showing the electronic trigger assembly attached, constructed according the present invention.

With respect to FIG. 10, FIG. 10 illustrates electronic trigger assembly 200 being attached to the top of paintball land mine 1000 such that electronic trigger assembly 200 is located adjacent to manual trigger assembly 1100. It is to be understood that electronic trigger assembly 200 is substantially the same as discussed above. Preferably, electronic trigger assembly 200 is constructed of electronic trigger 202, conventional battery 204, conventional receiver 206, and conventional solenoid 208 having a movable extension 210 such that movable extension 210 is capable of interacting with trip pin 1108 on manual trigger assembly 1100 in order to activate paintball land mine 1000, as will be discussed in greater detail later. Battery 202 should be constructed such that battery 202 is capable of providing the required power to electronic trigger assembly 200. Also, receiver 206 should be constructed such that receiver 206 is capable of receiving electronic signals from a conventional remote-control device 212. In this manner, remote-control device 212 can be conventionally used to send an electronic signal to receiver 206 in order to cause solenoid 208 and extension 210 to interact with trip pin 1108 in order to activate paintball land mine 1000. Finally, solenoid 208 should be capable of receiving a signal from receiver 206 that will cause solenoid 208 to move extension 210 such that movable extension 210 is capable of interacting with trip pin 1108 in order to activate paintball land mine 1000.

A unique aspect of the present invention is the use of electronic trigger assembly 200. Electronic trigger assembly 200 allows for the remote-control activation of paintball land mine 1000. In particular, remote-control device 212 can be conventionally used to send an electronic signal to receiver 206 in order to cause electronic trigger assembly 200 to interact with trip pin 1108 in order to activate paintball land mine 1000. In this manner, the paintball land mine 1000 can be set on the field of play and fire multiple paintballs 18 (FIG. 11) with a high percentage for eliminating a player or players, or to guard an objective without the user having to be in close proximity to the paintball land mine 1000.

It is to be understood that while the use of an electronic trigger assembly 200 has been discussed, a conventional trip wire (not shown) can also be attached to the trip pin 1108. In this manner, the paintball land mine 1000 can still be set on the field of play and fire multiple paintballs 18 with a high percentage for eliminating a player or players, or to guard an objective without the user having to be in close proximity to the paintball land mine 1000.

Also shown in FIG. 10, is a portion of manual trigger assembly 1100. In particular, manual trigger assembly 1100 includes, in part, hammer hinge bolt 1102, trip pin 1108, cartridge 1110, hammer 1112, and opening 1114 which will be discussed in greater detail later.

With respect to FIGS. 11 and 12A-12C there is illustrated in greater detail paintball land mine assembly 1004 and manual trigger assembly 1100. As shown in FIGS. 11 and 12A-12C, paintball land mine assembly 1000 includes, in part, opening 1005, removable/replaceable barrel assembly 1006, main body 1008, reed valve standoff 1010, combustion chamber assembly 1011, nail gun/blank firearm cartridge 1110, combustion chamber 1012, reed valve 1014, main body/reed valve manifold/barrel assembly expansion chamber 1016, paintball 18, barrel pre-detonation 1022, combustion chamber exhaust port 1024, barrel restrictor 1026, expansion/diverter section 1028, and barrel post detonation 1030. Preferably, barrel assembly 1006, main body 1008, reed valve standoff 1010, and reed valve 1014 are constructed of any suitable high strength, durable, heat resistant, high pressure resistant, UV resistant material.

It is to be understood that reed valve standoff 1010 and reed valve 1014 operate in substantially the same manner as discussed in U.S. Pat. No. 6,453,819 to Coates and titled "Paint Ball Grenade". In particular, a plurality of barrel restrictors 1026 are radially located to an outer surface of paintball land mine assembly 1004 in alignment with openings 1005.

Figure 11:
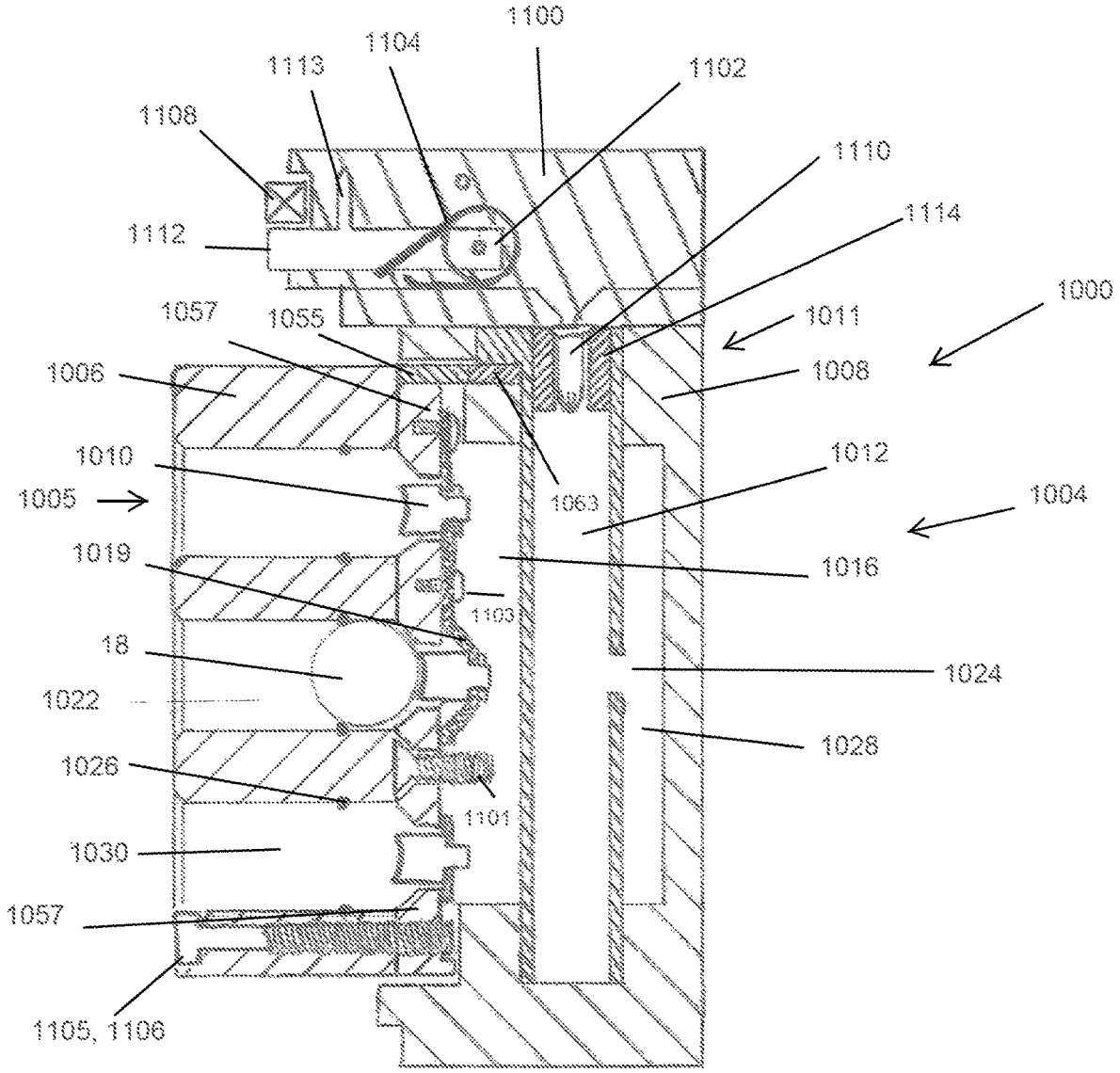
FIG. 11 is a schematic, side view of the another embodiment of the paintball land mine, taken along lines 11-11 of FIG. 8, constructed according the present invention.

As shown in FIGS. 11 and 12B, a flexible reed valve 1014 of rubber, plastic, metal or other suitable material is mounted to removable, reed valve manifold 1057 in a covering relation to each opening 1005. Reed valve 1014 can be constructed to be normally pre-biased to a position to close the respective opening 1005, although this is not required by the present invention. As shown in FIGS. 11 and 12B, each reed valve 1014 can be moved in a radially inward direction by inserting paintball 18 into barrel restrictor 1026 so as to provide fluid communication between the respective opening 1005 and main body/barrel assembly expansion chamber 1016. Although reed valves 1014 are shown attached at only one end, reed valves 1014 can be attached at opposite ends on opposite sides of openings 1005 so that only the middle portion of each reed valve 1014 moves in a radially inward direction. A reed valve standoff 1010 is secured to the radially directed outer surface of each reed valve 1014 and extends through the respective opening 1005 and partially within the barrel restrictor 1026. Finally, reed valve manifold 1057 includes an opening 1058 (FIG. 2B) that will allow barrel assembly key 1055 (FIG. 12A) to slide through reed valve manifold 1057 and interact with combustion chamber key 1063 (FIG. 12C), as will be discussed in greater detail later.

Another unique aspect of the present invention is the use of reed valve standoff 1010 and reed valve 1014. In particular, initially, the propellant exits very fast through openings 1005 to push out and fire paint balls 18 from barrel restrictor 1026. However, after the first paint ball 18 is fired, the resistance provided by that paint ball 18 against reed valve standoff 1010 and reed valve 1014 no longer exists so that the propellant would quickly exit out of the barrel restrictor 1026 from which the first paint ball 18 was fired, since this is the path of least resistance. However, after each paint ball 18 is fired, the respective reed valve standoffs 1010 are no longer restrained, so that the propellant then forces the respective reed valves 1014 to the closed position of FIG. 11, thus sealing the respective openings 1005. In this manner, the remaining propellant is still used to fire the other paint balls 18.

Another unique aspect of the present invention is that since the reed valve manifold 1057 is constructed so as to be removable and replaceable (i.e., field serviceable), different versions of the reed valve manifold 1057 can be attached to the barrel assembly 1006 and the main body 1008, as will be discussed in greater detail later.

A still another unique aspect of the present invention is removable, replaceable (i.e., field serviceable) barrel assembly 1006. As shown in FIGS. 11 and 12A, removable, replaceable barrel assembly 1006 includes, in part, barrel pre-detonation 1022, barrel post detonation 1030, and barrel assembly key 1055. As shown in FIGS. 11 and 12A, barrel assembly key 1055 is constructed so as to slide through the opening 1058 (FIG. 12B) in reed valve manifold 1057 and interact with combustion chamber key 1063 (FIG. 12C), as will be discussed in greater detail later.

Another unique aspect of the present invention is removable, replaceable combustion chamber assembly 1011. As shown in FIGS. 11 and 12C, removable, replaceable (i.e., field serviceable) combustion chamber assembly 1011 includes, in part, nail gun/blank firearm cartridge 1110, combustion chamber 1012, breach 1114, combustion chamber exhaust port 1024, and combustion chamber key 1063. As shown in FIGS. 11 and 12C, combustion chamber key 1063 is constructed so that as barrel assembly key 1055 (FIG. 12A) is slid through the opening 1058 (FIG. 12B) in reed valve manifold 1057, barrel assembly key 1055 is able to interact with combustion chamber key 1063, as will be discussed in greater detail later. It is to be understood that nail gun/blank firearm cartridge 1110 is any conventional nail gun or blank firearm cartridge or a round is a type of pre-assembled, blank firearm ammunition packaging a propellant substance (usually either smokeless powder or gun powder) and an ignition device (primer) within a metallic, paper, or plastic case. It is to be further understood that nail gun/blank firearm cartridge 1110 should be made to fit within the breach 1114.

With respect to manual trigger assembly 1100, as shown in FIGS. 11 and 13, manual trigger assembly 1100 includes in part, hammer hinge bolt 1102, torsion spring 1104, trip pin 1108, hammer 1112, hammer pin 1113, and cartridge opening 1114. Preferably, hammer hinge bolt 1102, torsion spring 1104, trip pin 1108, hammer 1112, and hammer pin 1113 are constructed of any suitable high strength, durable, heat resistant, high pressure resistant, UV resistant material. It is to be understood that hammer 1112 is conventionally attached to hammer hinge bolt 1102 by conventional fastening techniques such as welding, soldering, adhesives or the like. As will be discussed in greater detail later, cartridge opening 1114 should be constructed so as to allow hammer pin 1113 to contact the cartridge 1110 in order to fire or otherwise ignite cartridge 1110 while allowing cartridge 1110 to firmly remain within breach 1114 as the cartridge 1110 is being fired.

Figure 14:
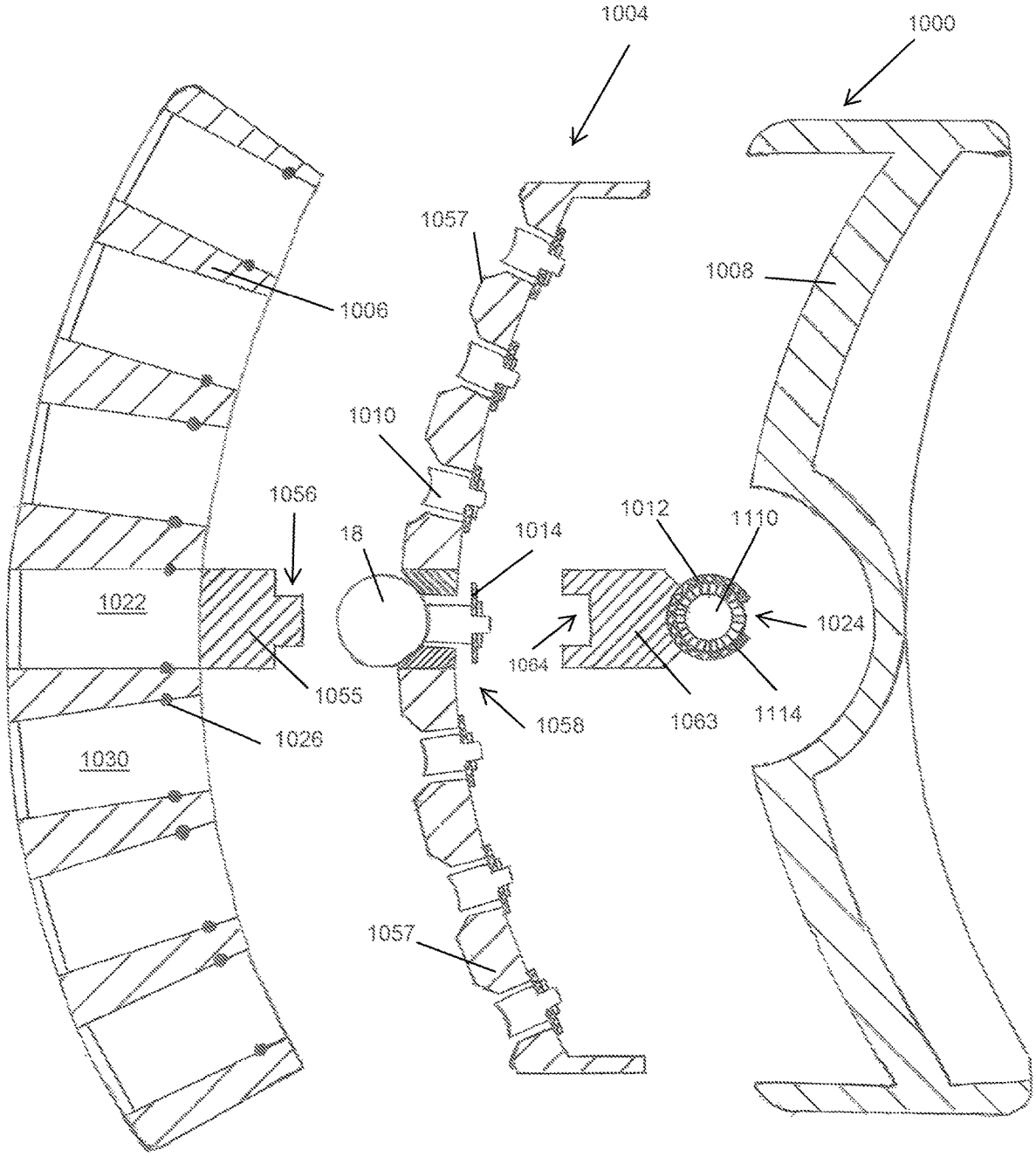
FIG. 14 is an exploded top view of the another embodiment of the paintball land mine, illustrating the barrel assembly, the reed valve manifold assembly, and the main body, constructed according the present invention.

With respect to FIG. 14, there is illustrated an exploded, top view of the paintball land mine assembly 1004. In particular, the separated barrel assembly 1006, the reed valve manifold assembly 1057, and the main body 1008 are illustrated. As discussed above, the interaction between barrel assembly key 1055, opening 1058, and combustion chamber key 1063 are more clearly illustrated.

A unique aspect of the present invention is the construction of barrel assembly key 1055, opening 1058, and combustion chamber key 1063. In particular, as shown in FIG. 14, barrel assembly key 1055 includes a tab 1056 and combustion chamber key 1063 includes a slot 1064. Furthermore, tab 1056 is constructed to fit into matching slot 1064 when barrel assembly key 1055 is passed through opening 1058 and interacts with combustion chamber key 1063. In this manner, since tab 1056 is only capable of matching up with a particular slot 1064, this will prevent the wrong combination of barrel assembly 1006 and combustion chamber 1012 on main body 1008 from being installed, as will be discussed in greater detail later.

Figure 15A:
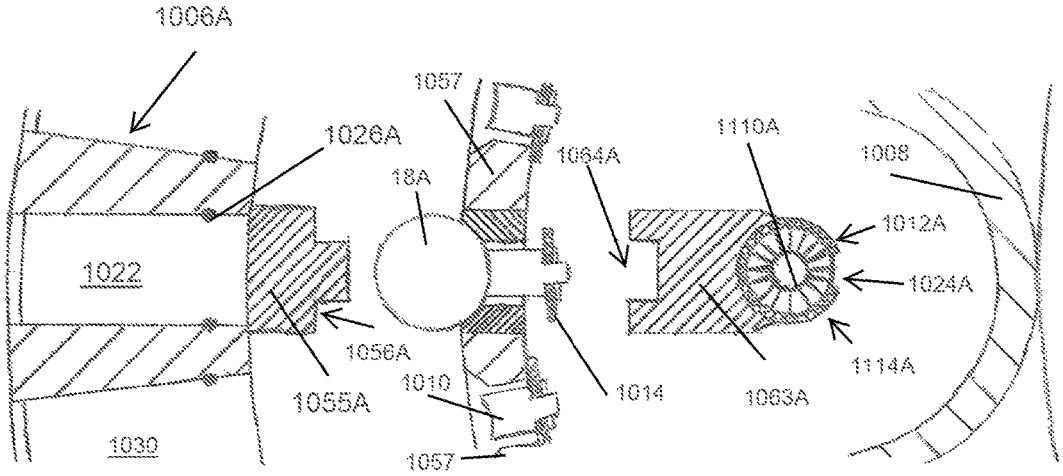
FIGS. 15A-15C are exploded top views of the another embodiment of the paintball land mine, illustrating various construction combinations of the barrel assembly, the reed valve manifold assembly, and the main body, constructed according the present invention.
Figure 15B:
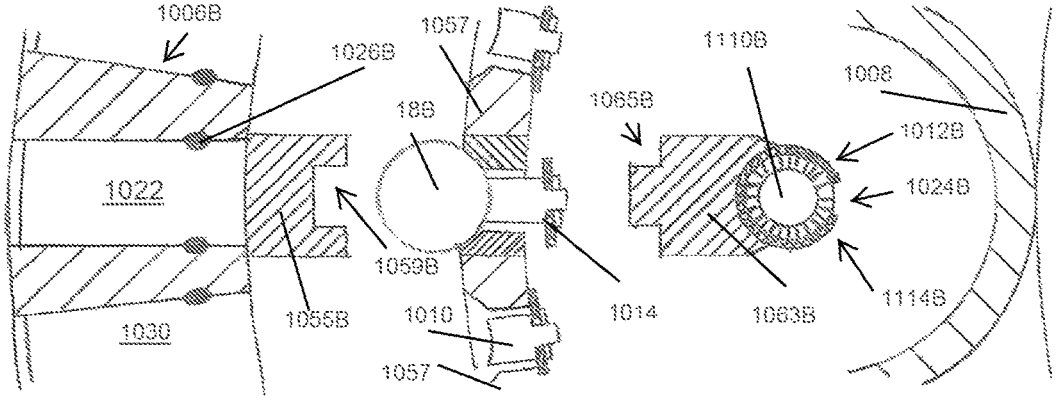
Figure 15C:
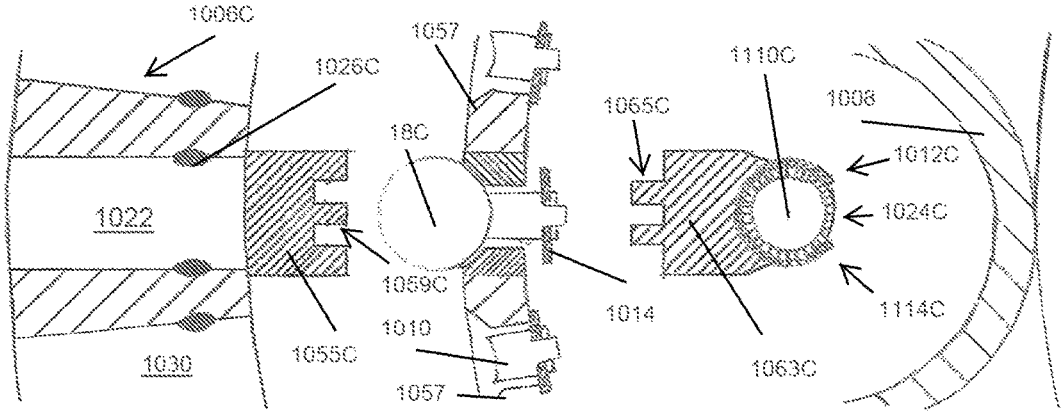

With respect to FIGS. 15A-15C, there are illustrated several different combinations of barrel assemblies 1006A-1006C and combustion chambers 1012A-1012C. In particular, with respect to FIG. 15A, assume that it is desired to utilize a low power projectile 18A in paintball land mine assembly 1004. In this example, assume that a low power projectile means using a lower power cartridge 1110A (such as a .27 caliber cartridge having a slow propellant burn rate), the combustion chamber exhaust port 1024A has an opening range of 0.25 inches×0.25 inches, the barrel restrictor 1026A is approximately 0.02 inches in diameter, the projectile 18A is a paint ball/closed cell slug, and the approximate projectile f.p.s. range is 90/110. As shown in FIG. 15A, the barrel assembly 1006A is equipped with a barrel assembly key 1055A having a tab 1056A. The combustion chamber 1012A is equipped with a combustion chamber key 1063A having a slot 1064A. In this manner, the tab 1056A is only capable of matching up with the slot 1064A so that only barrel assembly 1006A is capable of being combined with combustion chamber 1012A.

With respect to FIG. 15B, assume that it is desired to utilize a medium power projectile 18B in paintball land mine assembly 1004. In this example, assume that a medium power projectile means using a medium power cartridge 1110B (such as a .38 cartridge having a fast propellant burn rate), the combustion chamber exhaust port 1024A has an opening range of 0.25 inches×0.5 inches, the barrel restrictor 1026A is approximately 0.04 inches in diameter, the projectile 18B is a paint ball, pepper ball or a UV marker, and the approximate projectile f.p.s. range is 260/280. As shown in FIG. 15B, the barrel assembly 1006B is equipped with a barrel assembly key 1055B having one (1) slots 1059B. The combustion chamber 1012B is equipped with a combustion chamber key 1063B having one (1) tab 1065B. In this manner, the slot 1059B is only capable of matching up with the tab 1065B so that only barrel assembly 1006B is capable of being combined with combustion chamber 1012B.

With respect to FIG. 15CB, assume that it is desired to utilize a high-power projectile 18C in paintball land mine assembly 1004. In this example, assume that a high-power projectile means using a high-power power cartridge 11100 (such as a .44 caliber cartridge having an explosive propellant burn rate), the combustion chamber exhaust port 1024A has an opening range of 0.5 inches×0.5 inches, the barrel restrictor 1026A is approximately 0.075 inches in diameter, the projectile 18C is a rubber ball, and the approximate projectile f.p.s. range is 380/400. As shown in FIG. 15C, the barrel assembly 1006C is equipped with a barrel assembly key 1055C having two (2) slots 1059C. The combustion chamber 1012C is equipped with a combustion chamber key 1063C having two (2) tabs 1065C. In this manner, the slots 1059C are only capable of matching up with the tabs 1065C so that only barrel assembly 1006C is capable of being combined with combustion chamber 1012C.

Figure 16A:
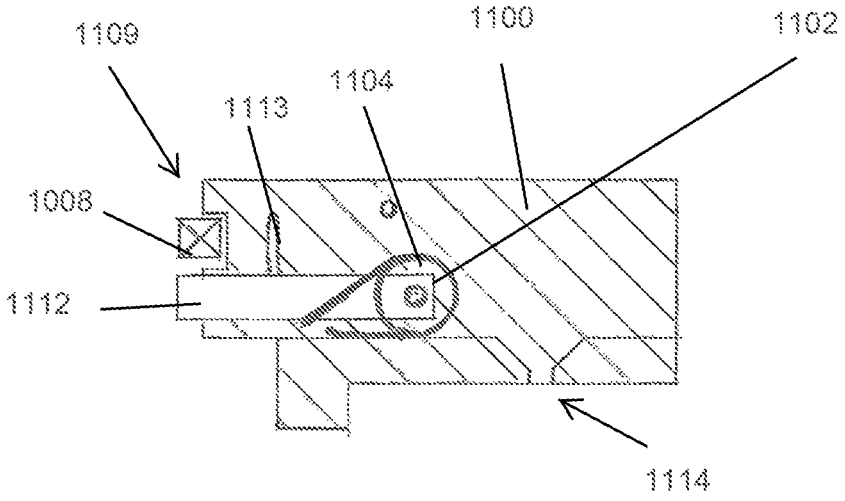
FIGS. 16A and 16B are a schematic, top views of the another embodiment of the paintball land mine, taken along lines 13-13 of FIG. 8 with the trigger assembly in a pre-detonation mode and a post-detonation mode, respectively, constructed according the present invention.

With respect to FIG. 16A, there is illustrated manual trigger assembly 1100, prior to activation (pre-detonation) of manual trigger assembly 1100. As discussed above, trigger assembly 1110 includes, in part, hammer hinge bolt 1102, torsion spring 1104, trip pin 1108, hammer 1112, hammer pin 1113, and opening 1114. As shown in FIG. 16A, hammer 1112 is rotated into a locked position adjacent to the trip pin 1108 such that trip pin 1108 retains hammer 1112 in place by locating trip pin 1108 within groove 1109. It is to be understood that the rotation of hammer 1112 creates torsion on torsion spring 1104. In this manner, once the trip pin 1108 is removed away from groove 1109 and hammer 1112, the force on torsion spring 1104 will cause hammer 1112 to rotate quickly towards opening 1114.

Figure 16B:
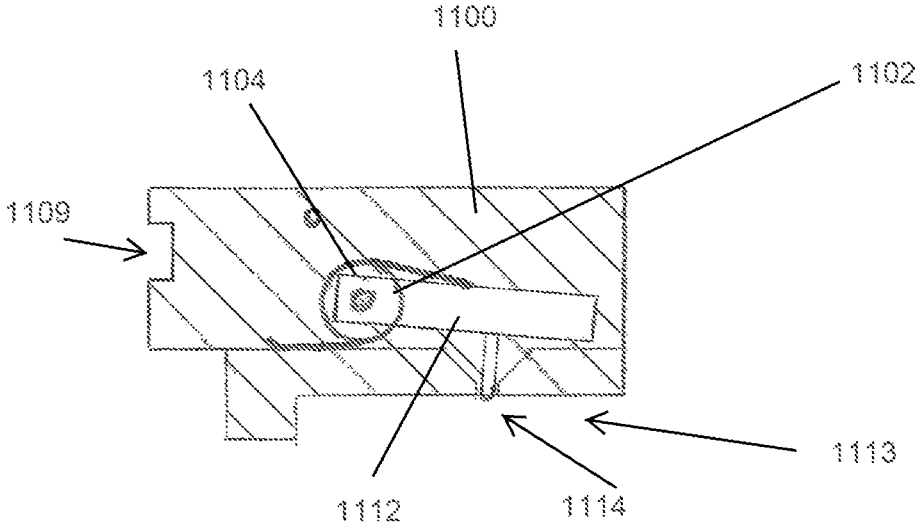

With respect to FIG. 16B, there is illustrated manual trigger assembly 1100, after activation (post-detonation) of manual trigger assembly 1100. As shown in FIG. 16B, trip pin 1108 has been removed from groove 1109 so that trip pin 1108 no longer retains hammer 1112 in place. As discussed above, since the rotation of hammer 1112 creates torsion on torsion spring 1104, once the trip pin 1108 has been removed from groove 1109, the torsional force from torsion spring 1108 will cause hammer 1112 to rotate quickly on hammer hinge bolt 1102 towards opening 1114 so that hammer pin 1113 contacts cartridge 1110 (FIG. 11) to cause the conventional firing of cartridge 1110. Once the cartridge 1110 has been fired (or activated), the propellant created from the firing of the gun powder in cartridge 1110 will enter into combustion chamber 1012, as will be described in greater detail later.

Method of Using the Paintball Land Mine

With respect to the method of using paintball land mines 2 and 1000 and with reference to FIGS. 1-18, as discussed above, it is a common misconception that gun powder is an explosive. In fact, it is a propellant. Therefore, certain conditions must be met for it to burn, namely heat and pressure. In a conventional firearm, this is achieved by the projectile being crimped into the cartridge during manufacturing, and the tight fit between the projectile and the barrel. It is to be understood that the projectile in the cartridge has been removed. Instead, as discussed above, the cartridge 110 or 1110 is any conventional nail gun or blank firearm cartridge 110 or 1110 or a round that is a type of pre-assembled, blank firearm ammunition packaging a propellant substance (usually either smokeless powder or gun powder) and an ignition device (primer) within a metallic, paper, or plastic case.

During the operation of paintball land mine 2 or 1000, assume that remote-control device 212 can be conventionally used to send an electronic signal to receiver 206 in order to cause electronic trigger assembly 200 to interact with trip pin 108 or 1108 in order to activate paintballs landmine 2 or 1000. It is to be understood that a conventional trip wire (not shown) or other similar detonation device can also be used to activate or otherwise detonate paintball land mine 2 or 1000.

As discussed earlier, the user places the paintball land mine 2 or 1000 on the field of play so that the paintball land mine 2 or 1000 will be able to fire multiple paintballs 18 with a high percentage for eliminating a player or players, or to guard an objective.

Once the paintball land mine 2 or 1000 has been placed at it desired location, the user then conventionally connects the electronic trigger assembly 200 to the manual trigger assembly 100 or manual trigger assembly 1100. In particular, the receiver 206 should be constructed such that receiver 206 is capable of receiving electronic signals from a conventional remote-control device 212. In this manner, remote-control device 212 can be conventionally used to send an electronic signal to receiver 206 in order to cause electronic trigger assembly 200 to interact with trip pin 108 or 1108 in order to activate landmine assembly 2 or 1000. More particularly, solenoid 208 should be capable of receiving a signal from receiver 206 that will cause solenoid 208 to move extension 210 such that movable extension 210 is capable of interacting with trip pin 108 or 1108 in order to activate paintball land mine 2 or 1000 by causing trip pin 108 or 1108 to become dislodged from groove 109 or 1109 in order to allow hammer 112 or 1112 to rotate and contact cartridge 110 or 1110.

After hammer 112 or 1112 becomes dislodged from being retained by trip pin 108 or 1108, as discussed above, the force on torsion spring 104 or 1104 will cause hammer 112 or 1112 to rotate quickly towards cartridge 110 or 1110.

The force of the torsion spring 104 or 1104 will then cause the hammer 112 or hammer pin 1113 to contact cartridge 110 or 1110. As discussed earlier, the interaction of the hammer 112 or hammer pin 1113 on cartridge 110 or 1110 will cause the ignition of the gun powder in cartridge 110 or 1110. Once the cartridge 110 or 1110 has been fired (or activated), the propellant created from the firing of the gun powder in cartridge 110 or 1110 will enter in breach 114 or 1114.

Once the primer is struck, the short, hot pulse of gases that are produced are trapped along with the propellant, thereby causing some of the gun powder to ignite. Furthermore, still trapped inside the cartridge, the small amount of burning propellant ignites more propellant and a rapid expansion of pressure and heat begins until the limit of adhesion of the cartridge case are overcome, and the propellant is forced out of the cartridge 110 or 1110 and into the combustion chamber 12 or 1012.

The propellant consisting of a short pulse of hot, high-speed gases then proceeds down along combustion chamber 12 or 1012. It is to be understood that the rearward facing combustion chamber exhaust port 24 or 1024 directs the hot, high-speed gases against the heat shield 20 (FIGS. 1-7 only), thereby causing the hot, high-speed gases to spread out, slow down, and cool down. It is to be understood that with respect to FIGS. 8-17, due to the extremely high pressures in the combustion chamber 1012, along with the use of center fire and rim fire cartridges 1110, the breach block 114 is no longer needed. Instead, the trigger assembly 1110 will act as a retainer for the cartridge 1110. Furthermore, while the combustion chamber 12 or 1012 serves as a divider to split the hot, high-speed gases, further progression of the hot, high-speed gases causes the hot, high speed gases to enter into the main body/barrel assembly expansion chamber 16 or 1016. Once in the in the main body/barrel assembly expansion chamber 16 or 1016, the hot, high-speed gases then reconverge around the combustion chamber 12 or 1012. This collision along with the further expansion of the hot, high-speed gases creates a loss of heat which results in an environment that is compatible with the reed valves 14 or 1014. The hot, high-speed gases have now been altered (or massaged) so that the massaged hot, high-speed gases now head down the remainder of the main body/barrel assembly expansion chamber 16 or 1016.

Regarding reed valve standoffs 10 and 1010 and reed valves 14 and 1014, as discussed earlier, a plurality of barrel restrictors 26 or 1026 are radially located to an outer surface of paintball land mine assembly 4 or 1004 in alignment with openings 5 or 1005. A flexible reed valve 14 or 1014 of rubber, plastic, metal or other suitable material has one end mounted to the inner surface of annular wall 7 in covering relation to each opening 5 (FIGS. 1-7) or mounted to reed valve manifold 1057 (FIGS. 8-17). Reed valve 14 or 1014 can be constructed to be normally pre-biased to a position to close the respective opening 5 or 1005, although this is not required by the present invention. As shown in FIGS. 4 and 11, each reed valve 14 or 1014 can be moved in a radially inward direction by inserting paintball 18 into barrel restrictor 26 or 1026 to provide fluid communication between the respective opening 5 or 1005 and main body/barrel assembly expansion chamber 16 or 1016. Although reed valves 14 or 1014 are shown attached at only one end, reed valves 14 or 1014 can be attached at opposite ends on opposite sides of openings 5 or 1005 so that only the middle portion of each reed valve 14 or 1014 moves in a radially inward direction. A reed valve standoff 10 or 1010 is secured to the radially directed outer surface of each reed valve 14 or 1014 and extends through the respective opening 5 or 1005 and partially within the barrel restrictor 26 or 1026.

Another unique aspect of the present invention is the use of reed valve standoff 10 or 1010 and reed valve 14 or 1014. In particular, initially, the propellant exits very fast through openings 5 or 1005 to push out and fire paint balls 18 from barrel restrictor 26 or 1026. However, after the first paint ball 18 is fired, the resistance provided by that paint ball 18 against reed valve standoff 10 or 1010 and reed valve 14 or 1014 no longer exists so that the propellant would quickly exit out of the barrel restrictor 26 or 1026 from which the first paint ball 18 was fired, since this is the path of least resistance. However, after each paint ball 18 is fired, the respective reed valve standoffs 10 or 1010 are no longer restrained, so that the propellant then forces the respective reed valves 14 or 1014 to the closed position of FIGS. 4 and 11, thus sealing the respective openings 5 or 1005. In this manner, the remaining propellant is still used to fire the other paint balls 18.

A still another unique aspect of the present invention is the ability to be able to aim or otherwise direct the exhaust from the firing of the cartridge 110 or 1110. It is to be understood that if the hot, high-speed gases were allowed to escape in all directions, the result would be the destruction of the delicate reed valves 14 or 1014. In particular, in the present invention, a rearward facing combustion chamber exhaust port 24 directs the hot, high-speed gases against the heat shield 20, thereby causing the hot, high-speed gases to spread out, slow down, and cool down (FIGS. 1-7). It is to be understood that with respect to FIGS. 8-17, due to the extremely high pressures in the combustion chamber 1012, along with the use of center fire and rim fire cartridges 1110, the breach block 114 is no longer needed. Instead, the trigger assembly 1110 will act as a retainer for the cartridge 1110. While the combustion chamber 12 or 1012 serves as a divider to split the hot, high-speed gases, further progression of the hot, high-speed gases causes the hot, high-speed gases to enter into the main body/barrel assembly expansion chamber 16 or 1016. Once in the in the main body/barrel assembly expansion chamber 16 or 1016, the hot, high-speed gases then reconverge around the combustion chamber 12 or 1012. This collision along with the further expansion of the hot, high-speed gases creates a loss of heat which results in an environment that is compatible with the reed valves 14 or 1014. The hot, high-speed gases have now been altered (or massaged) so that the massaged hot, high-speed gases now head down the remainder of the main body/barrel assembly expansion chamber 16 or 1016.

It is to be understood that once the primer is struck, the short, hot burst of gases that are produced are trapped along with the propellant, thereby causing some of the gun powder to ignite. Furthermore, still trapped inside the cartridge, the small amount of burning propellant ignites more propellant and a rapid expansion of pressure and heat begins until the limit of adhesion of the cartridge case is overcome, and the short burst of hot, high-speed gases is forced out of the cartridge and into the breach 114 or 1114. Forces within the combustion chambers 12 or 1012 require the highest pressures thereby, resulting in a complete propellant burn, hundreds of pounds of pressure, and heat.

Given the above, in terms of the present invention, if one were to remove the combustion chamber 12 (FIGS. 4 and 5) or 1012 (FIGS. 11 and 12C) and strike the cartridge 110 or 1110, detonation of the primer (not shown) within the cartridge would have enough force to open the cartridge 110 or 1110 and eject propellant into the body/barrel assembly expansion chamber 16 or 1016. However, the small amount of burning propellant ignited by the primer lacks a confined space to ignite any further propellant, thereby resulting in a very low, incomplete burn of the propellant.

Another unique aspect of the present invention is that by using a combustion chamber 12 or 1012, one will see that there is a now confined space that creates a high heat, high pressure environment for the unignited propellant which results in a more complete burn of the propellant.

A still another unique aspect of the present invention is the ability to be able to aim or otherwise direct the exhaust from the firing of the cartridge 110 or 1110. It is to be understood that if the hot, high-speed gases were allowed to escape in all directions, the result would be the destruction of the delicate reed valves 14 or 1014. In particular, in the present invention, a rearward facing combustion chamber exhaust port 24 directs the hot, high-speed gases against the heat shield 20, thereby causing the hot, high-speed gases to spread out, slow down, and cool down (FIGS. 1-7). It is to be understood that with respect to FIGS. 8-17, due to the extremely high pressures in the combustion chamber 1012, along with the use of center fire and rim fire cartridges 1110, the breach block 114 is no longer needed. Instead, the trigger assembly 1110 will act as a retainer for the cartridge 1110. While the combustion chamber 12 or 1012 serves as a divider to split the hot, high-speed gases, further progression of the hot, high-speed gases causes the hot, high-speed gases to enter into the main body/barrel assembly expansion chamber 16 or 1016. Once in the main body/barrel assembly expansion chamber 16 or 1016, the hot, high-speed gases then reconverge around the combustion chamber 12 or 1012. This collision along with the further expansion of the hot, high-speed gases creates a loss of heat which results in an environment that is compatible with the reed valves 14 or 1014. The hot, high-speed gases have now been altered (or massaged) so that the massaged hot, high-speed gases now head down the remainder of the main body/barrel assembly expansion chamber 16 or 1016.

Figure 17:
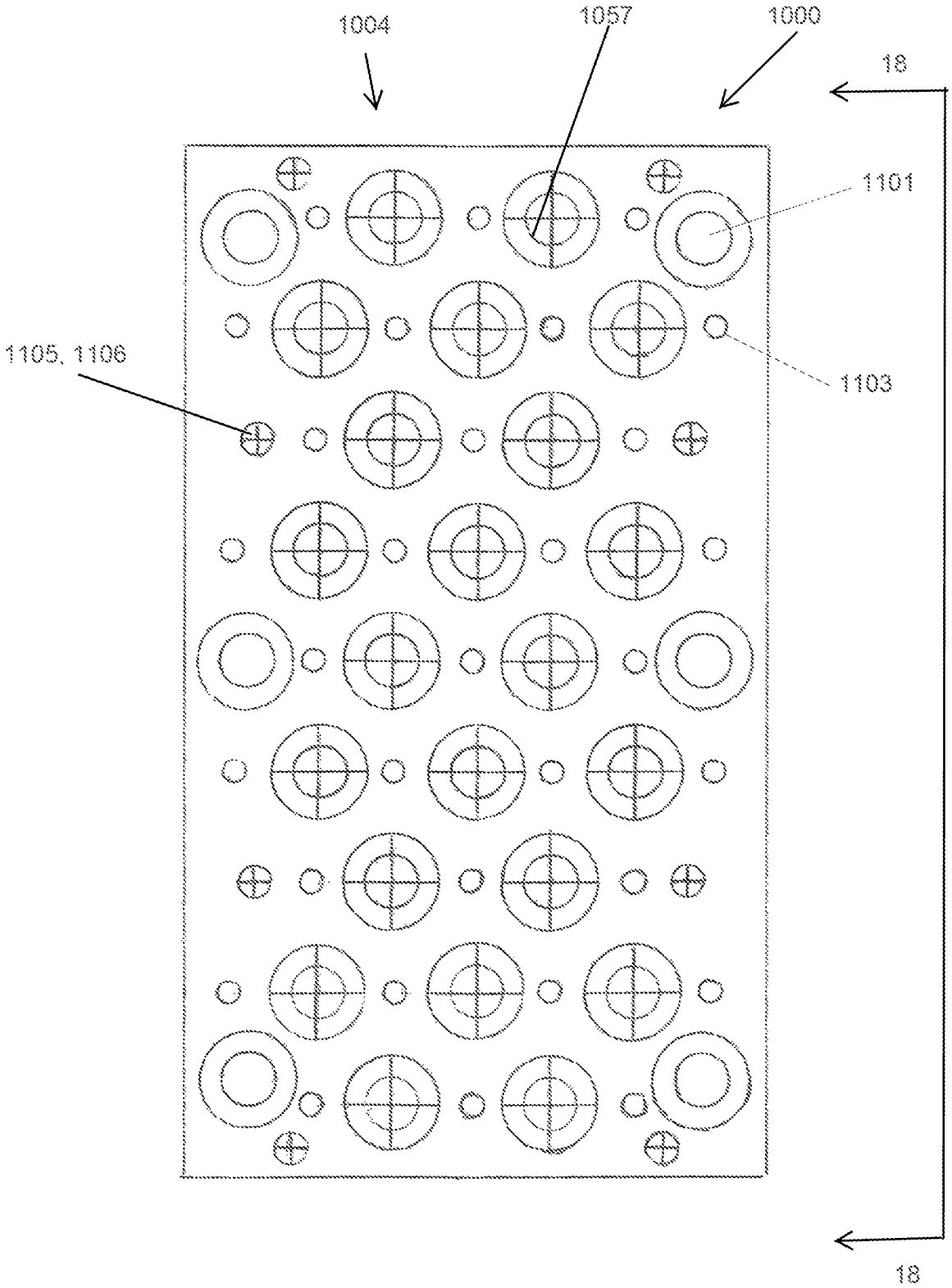
FIG. 17 is a schematic, front view of the another embodiment of the paintball land mine, constructed according the present invention.
Figure 18:
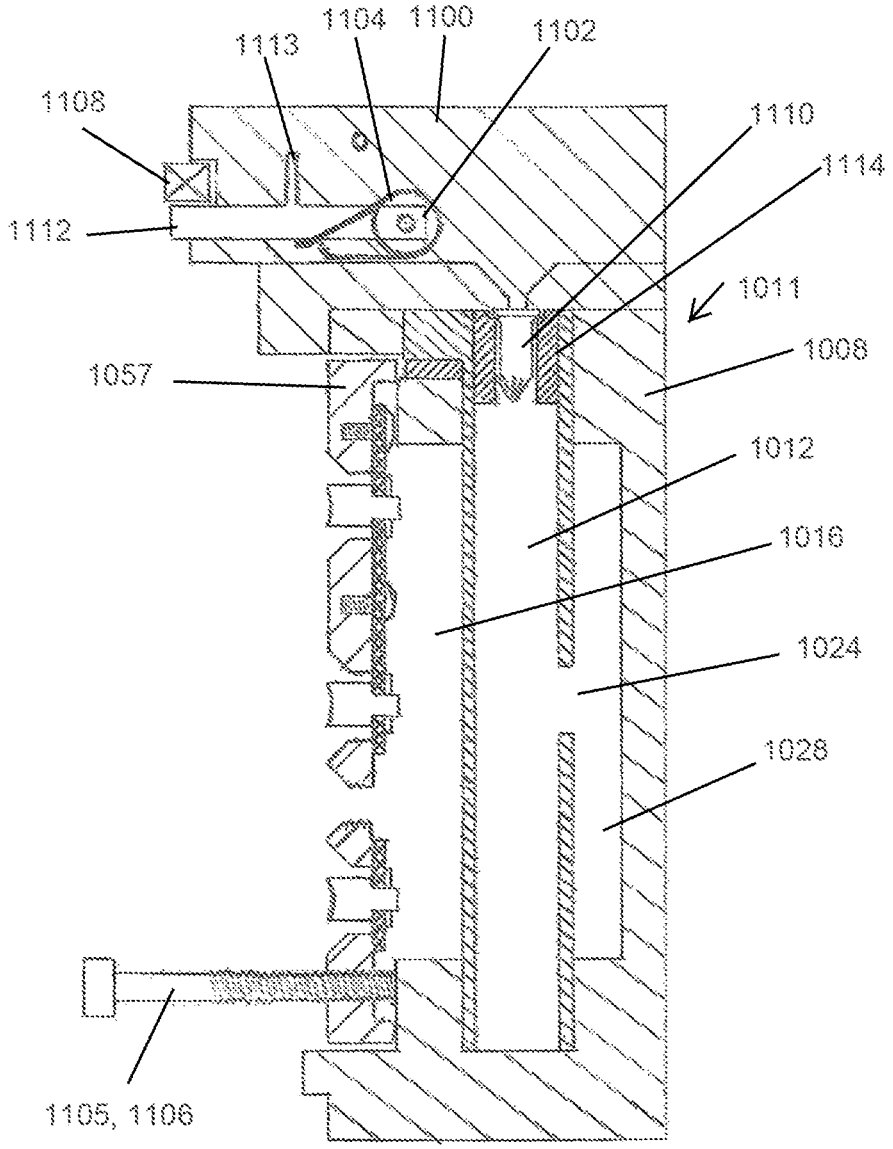
FIG. 18 is a schematic, side view of the another embodiment of the paintball land mine, taken along lines 18-18 of FIG. 17 with the barrel assembly and reed valve manifold removed, constructed according the present invention.

With respect to FIGS. 11, 17, and 18, a unique aspect of the present invention is that the barrel assembly 1006 and the combustion chamber 1012 are removable and replaceable (i.e., field serviceable). In particular, in order to service any damaged reed valves 1014, the reed valve manifold 1057 must be removed from the main body 1008. First, the bolts 1101 (FIG. 17) attaching barrel assembly 1006 to reed valve manifold 1057 are then conventionally removed. Second, the bolts 1105 attaching the reed valve manifold 1057 to the main body 1008 are removed. Third, the jack bolts 1106 (FIG. 18) are installed into the openings 1107 where the bolts 1105 were removed. Fourth, the jack bolts 1106 are tightened so that the reed valve manifold 1057 is lifted from and forced away from the main body 1008. Fifth, the desired combustion chamber 1012*a*-1012C is installed on main body 1018. Sixth, the desired reed valve manifold 1057A-1057C is installed so that opening 1058 is located over the combustion chamber key 1063A-1063C. Seventh, the desired barrel assembly 1006A-1006C is installed over the reed valve manifold 1057A-1057C so that the barrel assembly key 1055A-1055C is correctly aligned with the proper combustion chamber key 1063A-1063C, as discussed above. Finally, the desired projectile 18A-18C is installed on the reed valve manifold 1057A-1057C through the openings 1005 and past the barrel restrictors 1026, as discussed above.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

All of the features disclosed in this specification may be combined in any combination. Thus, unless expressly stated otherwise, each feature disclosed is only an example of a generic series of equivalent or similar features.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other modifications and implementations will occur to those skilled in the art without departing from the spirit and the scope of the invention. Accordingly, the description hereinabove is not intended to limit the invention.

Therefore, provided herein is a new and improved paintball land mine, which according to various embodiments of the present invention, offers the following advantages: ease of use; lightness in weight; durability; reusability; the ability to fire multiple paintballs simultaneously; the ability to utilize a firearm blank or nail gun cartridge for its propellant; the use of reed valves associated with the ejection of the paintballs; the ability to substantially prevent the rapid escape of unused propellant; the ability to detonate the land mine using a trip wire; the ability to use a wide range of projectile types; the ability to use a wide range of f.p.s. projectile types; the ability to be able to disassemble/service the device; and the ability to detonate the land mine using a remote-control device.

In fact, in many of the preferred embodiments, these advantages of ease of use, lightness in weight, durability, reusability, the ability to fire multiple paintballs simultaneously, the ability to utilize a firearm blank or nail gun cartridge for its propellant, the use of reed valves associated with the ejection of the paintballs, the ability to substantially prevent the rapid escape of unused propellant, the ability to detonate the land mine using a trip wire, the ability to use a wide range of projectile types, the ability to use a wide range of f.p.s. projectile types, the ability to be able to disassemble/service the device, and the ability to detonate the land mine using a remote-control device are optimized to an extent that is considerably higher than heretofore achieved in prior, known paintball firing devices.

I claim:

1. A paintball land mine, wherein the paintball land mine comprises:

a paintball land mine assembly further comprising, a removable barrel assembly, a plurality of barrel restrictors located along a first side of the removable barrel assembly, a plurality of openings located on a second side of the removable barrel assembly, a removable reed valve manifold located adjacent to the removable barrel assembly and the plurality of barrel restrictors and covering the first side of the removable barrel assembly, a plurality of paintballs such that each of the plurality of paintballs is located adjacent to the reed valve manifold and at least one of the barrel restrictors, a removable combustion chamber located adjacent to the reed valve manifold, wherein the removable combustion chamber is in fluid communication with the reed valve manifold and wherein the removable combustion chamber further includes a pre-assembled, blank firearm ammunition cartridge;

a main body located adjacent to the removable combustion chamber;

a plurality of jack bolts operatively connected to the removable reed valve manifold, wherein the plurality of jack bolts is capable of assisting in removing the removable reed valve manifold from the main body; and a manual trigger assembly operatively connected to the paintball land mine assembly and the pre-assembled, blank firearm ammunition cartridge.

2. The paintball land mine, according to claim 1, wherein the reed valve manifold further comprises:

a flexible reed valve;

a reed valve standoff operatively connected to the flexible reed valve; and an opening located on one end of the reed valve manifold.

3. The paintball land mine, according to claim 1, wherein the paintball land mine is further comprised of:

an expansion chamber located adjacent to the removable combustion chamber and in fluid communication with the removable reed valve manifold.

4. The paintball land mine, according to claim 2, wherein the removable combustion chamber is further comprised of:

a breach located at one end of the removable combustion chamber, wherein the pre-assembled, blank firearm ammunition cartridge is retained within the breach;

a combustion chamber key located adjacent to the breach;

a combustion chamber exhaust port located along a portion of the removable combustion chamber; and a diverter section located adjacent to the combustion chamber exhaust port.

5. The paintball land mine, according to claim 1, wherein the manual trigger assembly is further comprised of:

a hammer hinge bolt;

a torsion spring located on the hammer hinge bolt;

a hammer located adjacent to the torsion spring and operatively attached to the hammer hinge bolt;

a hammer pin located on one end of the hammer; and a trip pin located adjacent to the hammer, wherein the trip pin retains the hammer in a first position.

6. The paintball land mine, according to claim 5, wherein the paintball land mine is further comprised of:

an electronic trigger assembly operatively connected to the manual trigger assembly, wherein the electronic trigger assembly further comprises, a battery;

a receiver, wherein the receiver is electrically connected to the battery;

a solenoid, wherein the solenoid is electrically connected to the battery and wherein the solenoid is in electrical communication with the receiver; and an extension located on the solenoid and located adjacent to the trip pin.

7. The paintball land mine, according to claim 4, wherein the removable barrel assembly is further comprised of:

a barrel assembly key located adjacent to the first side of the barrel assembly, wherein a portion of the barrel assembly key is located within the opening and is configured to interact with the combustion chamber key.

8. A method of constructing a paintball land mine, wherein the method comprises:

providing a paintball land mine assembly further comprising, providing a removable barrel assembly, attaching a plurality of barrel restrictors along a first side of the removable barrel assembly, providing a plurality of openings on a second side of the removable barrel assembly, attaching a removable reed valve manifold to the removable barrel assembly adjacent to the plurality of barrel restrictors such that the removable reed valve manifold substantially covers the first side of the removable barrel assembly, providing a plurality of paintballs such that each of the plurality of paintballs is located adjacent to the reed valve manifold and at least one of the barrel restrictors, attaching a removable combustion chamber adjacent to the reed valve manifold, wherein the removable combustion chamber is in fluid communication with the reed valve manifold and wherein the removable combustion chamber further includes a pre-assembled, blank firearm ammunition cartridge, providing a main body, wherein the main body is located adjacent to the removable combustion chamber;

providing a plurality of jack bolts, wherein the plurality of jack bolts is operatively connected to the removable reed valve manifold, and wherein the plurality of jack bolts are capable of assisting in removing the removable reed valve manifold from the main body; and attaching a manual trigger assembly to the paintball land mine assembly, wherein the manual trigger assembly is located adjacent to the pre-assembled, blank firearm ammunition cartridge.

9. The method, according to claim 8, wherein the attaching the reed valve manifold further comprises:

providing a flexible reed valve;

attaching a reed valve standoff to the flexible reed valve; and providing an opening located on one end of the reed valve manifold.

10. The method, according to claim 8, wherein the method further comprises:

providing an expansion chamber adjacent to the removable combustion chamber, wherein the expansion chamber is in fluid communication with the removable reed valve manifold, and wherein the expansion chamber is located adjacent to the removable combustion chamber.

11. The method, according to claim 9, wherein the attaching the removable combustion chamber is further comprises:

providing a breach, wherein the breach is located at one end of the removable combustion chamber, and wherein the pre-assembled, blank firearm ammunition cartridge is retained within the breach;

providing a combustion chamber key adjacent to the breach;

providing a combustion chamber exhaust port along a portion of the removable combustion chamber; and providing a diverter section adjacent to the combustion chamber exhaust port.

12. The method, according to claim 8, wherein the attaching a manual trigger assembly is further comprises:

providing a hammer hinge bolt;

locating a torsion spring on the hammer hinge bolt;

providing a hammer adjacent to the torsion spring, wherein the hammer is operatively attached to the hammer hinge bolt;

attaching a hammer pin to one end of the hammer; and providing a trip pin adjacent to the hammer, wherein the trip pin retains the hammer in a first position.

13. The method, according to claim 12, wherein the method further comprises:

locating an electronic trigger assembly adjacent to the manual trigger assembly, wherein the electronic trigger assembly further comprises:

providing a battery;

electrically connecting a receiver to the battery;

electrically connecting a solenoid to the battery, wherein the solenoid is in electrical communication with the receiver; and providing an extension on the solenoid, wherein the extension is located adjacent to the trip pin.

14. The method, according to claim 11, wherein the providing a removable barrel assembly further comprises:

providing a barrel assembly key, wherein the barrel assembly key is located adjacent to the first side of the barrel assembly, and wherein a portion of the barrel assembly key is located within the opening and is configured to interact with the combustion chamber key.

15. A method of using a paintball land mine, wherein the method comprises:

providing a paintball land mine assembly further comprising, providing a removable barrel assembly, attaching a plurality of barrel restrictors along a first side of the removable barrel assembly, providing a plurality of openings on a second side of the removable barrel assembly, attaching a removable reed valve manifold adjacent to the removable barrel assembly adjacent to the plurality of barrel restrictors such that the removable reed valve manifold substantially covers the first side of the removable barrel assembly, providing a plurality of paintballs such that each of the plurality of paintballs is installed in one of the plurality of openings on the second side of the removable barrel assembly and each of the plurality of paintballs is located adjacent to the reed valve manifold and at least one of the barrel restrictors, attaching a removable combustion chamber adjacent to the reed valve manifold, wherein the removable combustion chamber is in fluid communication with the reed valve manifold and wherein the removable combustion chamber further includes a pre-assembled, blank firearm ammunition cartridge, providing a main body, wherein the main body is located adjacent to the removable combustion chamber;

attaching a manual trigger assembly to the paintball land mine assembly, wherein the manual trigger assembly is located adjacent to the pre-assembled, blank firearm ammunition cartridge; and upon determining that a different removable reed valve manifold and a different removable combustion chamber need to be installed in the paintball land mine assembly;

remove the removable barrel assembly, remove the removable reed valve manifold, wherein the remove the removable reed valve manifold further comprises:

removing a plurality of fasteners that are used to attach the removable reed valve manifold to the main body, inserting a plurality of jack bolts into the removable reed valve manifold, and using the plurality of jack bolts to assist in removing the removable reed valve manifold from the main body, remove the removable combustion chamber, install a new removable combustion chamber, install a new removable reed valve manifold by attaching the new removable combustion chamber to the new reed valve manifold, and re-attach the removable barrel assembly to the new removable reed valve manifold.

16. The method, according to claim 15, wherein the method further comprises:

providing a new plurality of paintballs such that each of the new plurality of paintballs is installed in one of the plurality of openings on the second side of the removable barrel assembly and each of the new plurality of paintballs is located adjacent to the reed valve manifold and at least one of the barrel restrictors.

17. The method, according to claim 15, wherein the remove the removable barrel assembly further comprises:

removing a plurality of fasteners that are used to attach the removable barrel assembly to the removable reed valve manifold.

18. The method, according to claim 15, wherein the manual trigger assembly further comprises:

providing a hammer hinge bolt;

locating a torsion spring on the hammer hinge bolt;

providing a hammer adjacent to the torsion spring, wherein the hammer is operatively attached to the hammer hinge bolt;

attaching a hammer pin to one end of the hammer; and providing a trip pin adjacent to the hammer, wherein the trip pin retains the hammer in a first position;

activating the trip pin to cause the trip pin to be moved away from the hammer;

rotating the hammer on the hammer hinge bolt through the use of the torsion spring; and contacting the hammer pin with the pre-assembled, blank firearm ammunition cartridge, wherein the contacting of the hammer pin with the pre-assembled, blank firearm ammunition cartridge causes the pre-assembled, blank firearm ammunition cartridge to fire.

19. The method, according to claim 18, wherein the method further comprises:

locating an electronic trigger assembly adjacent to the manual trigger assembly, wherein the electronic trigger assembly further comprises, providing a battery;

electrically connecting a receiver to the battery;

electrically connecting a solenoid to the battery, wherein the solenoid is in electrical communication with the receiver; and providing an extension on the solenoid, wherein the extension is located adjacent to the trip pin;

using the receiver to activate the solenoid;

interacting the solenoid with the trip pin;

moving the trip pin with the solenoid to cause the trip pin to be moved away from the hammer;

rotating the hammer on the hammer hinge bolt through the use of the torsion spring; and contacting the hammer pin with the pre-assembled, blank firearm ammunition cartridge, wherein the contacting of the hammer pin with the pre-assembled, blank firearm ammunition cartridge causes the pre-assembled, blank firearm ammunition cartridge to fire.

* * * * *